US012716409B2

(12) United States Patent
Kudo et al.

(10) Patent No.: US 12,716,409 B2
(45) Date of Patent: Aug. 25, 2026

(54) DIAPHRAGM PUMP, LIQUID DISCHARGE HEAD, AND LIQUID DISCHARGE APPARATUS

(71) Applicant: CANON KABUSHIKI KAISHA, Tokyo (JP)

(72) Inventors: Satoshi Kudo, Tokyo (JP); Satoshi Shimazu, Kanagawa (JP); Toshiaki Kaneko, Tokyo (JP); Kazuyuki Yoshida, Kanagawa (JP)

(73) Assignee: Canon Kabushiki Kaisha, Tokyo (JP)

( * ) Notice: Subject to any disclaimer, the term of this patent is extended or adjusted under 35 U.S.C. 154(b) by 174 days.

(21) Appl. No.: 18/301,154

(22) Filed: Apr. 14, 2023

(65) Prior Publication Data

US 2023/0340951 A1 Oct. 26, 2023

(30) Foreign Application Priority Data

Apr. 21, 2022 (JP) ..... 2022-069952

(51) Int. Cl.
*F04B 43/04* (2006.01)
*F04B 43/00* (2006.01)

(52) U.S. Cl.
CPC ..... *F04B 43/046* (2013.01); *F04B 43/0054* (2013.01)

(58) Field of Classification Search
CPC ..... F04B 43/046; F04B 43/0054
See application file for complete search history.

(56) References Cited

U.S. PATENT DOCUMENTS 4,495,432 A * 1/1985 Katsuma ..... H02N 2/163 310/82
2007/0048190 A1* 3/2007 Ifuku ..... H10N 30/076 422/400
2017/0159650 A1* 6/2017 Richter ..... F16K 99/0001

FOREIGN PATENT DOCUMENTS

JP S639481 U 1/1988
JP 2005307858 A 11/2005
JP 2008180161 A * 8/2008 ..... F04B 43/046
JP 2022000334 A 1/2022

OTHER PUBLICATIONS

JP2008180161A translation (Year: 2024).*
merriam-webster.com; Laminated Definition & Meaning—Merriam-Webster, from merriam-webster.com/dictionary/laminated (Year: 2025).*

* cited by examiner

*Primary Examiner* — David N Brandt
(74) *Attorney, Agent, or Firm* — Canon U.S.A., Inc. IP Division

(57) ABSTRACT

A diaphragm pump includes a piezoelectric member, a diaphragm having surfaces, and a supporting member. The piezoelectric member deforms when a voltage is applied. The diaphragm deforms in response to deformation of the piezoelectric member. The supporting member supports the diaphragm. A space is formed between the diaphragm and the supporting member. Fluid is made to flow by changing a volume of the space by deforming the diaphragm. The surfaces of the diaphragm face the space and include a first surface that deforms in response to deformation of the piezoelectric member and include a second surface not connected to the first surface. The diaphragm bonds to the supporting member with the second surface.

5 Claims, 22 Drawing Sheets

DIAPHRAGM PUMP, LIQUID DISCHARGE HEAD, AND LIQUID DISCHARGE APPARATUS

BACKGROUND

Field

The present disclosure relates to diaphragm pumps, liquid discharge heads, and liquid discharge apparatuses.

Description of the Related Art

In medical fields such as pharmaceutical administration and in technical fields such as fuel supply for fuel cells or ink supply for printing equipment, micropumps that pump a fixed amount of fluid with high accuracy are used. A known example of such pumps is a diaphragm pump disclosed in Japanese Patent Laid-Open No. 2008-180161.

Diaphragm pumps generally include a piezoelectric member that is deformed when a voltage is applied, a diaphragm that is deformed with the deformation of the piezoelectric member, and a supporting member that supports the diaphragm and forms a pump chamber with the diaphragm. In the diaphragm pump, when a voltage is applied to the piezoelectric member, the diaphragm vibrates with the deformation of the piezoelectric member. The volume of the pump chamber continuously increases or decreases in response to the vibration of the diaphragm. At that time, the pressure in the pump chamber decreases or increases to cause intake of fluid from the outside of the pump into the pump chamber and discharge of fluid from the pump chamber to the outside of the pump. Thus, the diaphragm pump has a simple and compact structure and can easily be installed in various equipment.

However, in the diaphragm pump disclosed in Japanese Patent Laid-Open No. 2008-180161 (FIGS. 24A and 24B), a vibration surface 654 of a diaphragm 652 adjacent to a pump chamber 657 is bonded to a supporting member 653, which causes a joint portion 655 to be subjected to the constant high-frequency vibration of the diaphragm 652. Specifically, at fluid intake, deformation of an electrode plate 651 due to deformation of a piezoelectric member 650 causes the diaphragm 652 to vibrate in the direction in which the volume of the pump chamber 657 increases, as shown in FIG. 24A. Of the vibration surface 654 that bonds to the joint portion 655, an inner portion and an outer portion are respectively referred to as vibration surfaces 654*a* and 654*b*. The bending deformation of the electrode plate 651 causes the vibration surface 654*b* to be pushed in the direction of arrow B and the vibration surface 654*a* to be influenced by a moment in the direction of arrow A away from the joint portion 655. In contrast, at fluid discharge, the deformation of the electrode plate 651 causes the diaphragm 652 to vibrate in the direction in which the volume of the pump chamber 657 decreases, as shown in FIG. 24B. At that time, the bending deformation of the electrode plate 651 causes the vibration surface 654*a* to be pushed in the direction of arrow A and the vibration surface 654*b* to be influenced by a moment in the direction of arrow B away from the joint portion 655. The diaphragm pump repeats the states in FIG. 24A and FIG. 24B alternately, which decreases the bonding strength of the diaphragm 652 and the supporting member 653.

As an outer peripheral edge 656 of the electrode plate 651 bonded to the diaphragm 652 separates from the joint portion 655 of the diaphragm 652 and the supporting member 653 toward the supporting member 653, a force F applied to the diaphragm 652 under the outer peripheral edge 656 increases, which increases the bending deformation, in other words, increases the effect of the moment applied to the vibration surface 654 at the intake and discharge of fluid, causing a prominent decrease in the bonding strength between the diaphragm 652 and the supporting member 653.

Similarly, in a case where the piezoelectric member 650 and the diaphragm 652 are directly bonded together without using the electrode plate 651, the vibration of the diaphragm 652 caused by the deformation of the piezoelectric member 650 decreases the bonding strength of the diaphragm 652 and the supporting member 653.

SUMMARY

The present disclosure provides a diaphragm pump in which a decrease in the bonding strength of the diaphragm and the supporting member is prevented by reducing the effect of the vibration of the diaphragm, as well as a liquid discharge head and a liquid discharge apparatus including the diaphragm pump.

According to an aspect of the present disclosure, a diaphragm pump includes a piezoelectric member configured to deform when a voltage is applied, a diaphragm having surfaces and configured to deform in response to deformation of the piezoelectric member, and a supporting member configured to support the diaphragm, wherein a space is formed between the diaphragm and the supporting member, wherein fluid is made to flow by changing a volume of the space by deforming the diaphragm, wherein the surfaces of the diaphragm face the space and include a first surface configured to deform in response to deformation of the piezoelectric member and include a second surface not connected to the first surface, and wherein the diaphragm bonds to the supporting member with the second surface.

Further features of the present disclosure will become apparent from the following description of exemplary embodiments with reference to the attached drawings.

DESCRIPTION OF THE EMBODIMENTS

Embodiments of the present disclosure will be described hereinbelow with reference to the drawings. It is to be understood that the following embodiments do not limit the present disclosure and that not all the combinations of the features described in the embodiments are absolutely necessary for the solution of the present disclosure. Like components are denoted by like reference signs. In the following description, the configuration of a diaphragm pump, which is a feature of the present disclosure, will be first described, and next, a liquid discharge head and a liquid discharge apparatus will be described.

First Embodiment

Diaphragm Pump

Figure 1A:
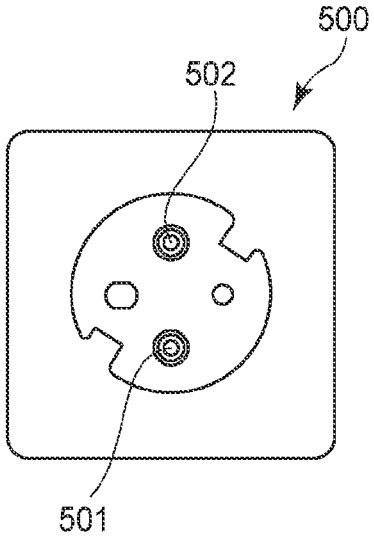
FIG. 1A is a front view of a diaphragm pump.
Figure 1B:
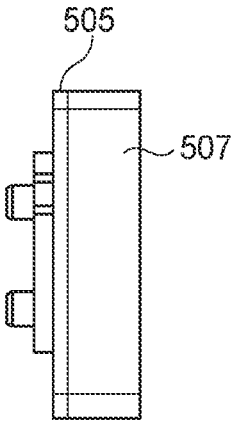
FIG. 1B is a side view of the diaphragm pump.
Figure 1C:
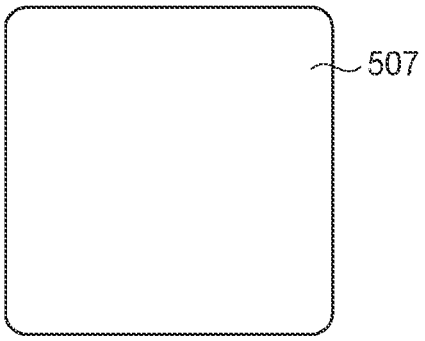
FIG. 1C is a back view of the diaphragm pump.

FIGS. 1A to 1C are schematic diagrams of a diaphragm pump 500. FIG. 1A is a front view of the diaphragm pump 500. FIG. 1B is a side view of the diaphragm pump 500. FIG. 1C is a back view of the diaphragm pump 500. The diaphragm pump 500 has an intake hole 501 for the diaphragm pump 500 to such fluid at the lower part. The diaphragm pump 500 has a discharge hole 502 for discharging fluid from the diaphragm pump 500 at the upper part. In other words, the fluid entering through the intake hole 501 passes through the diaphragm pump 500 and is discharged through the discharge hole 502.

Figure 12:
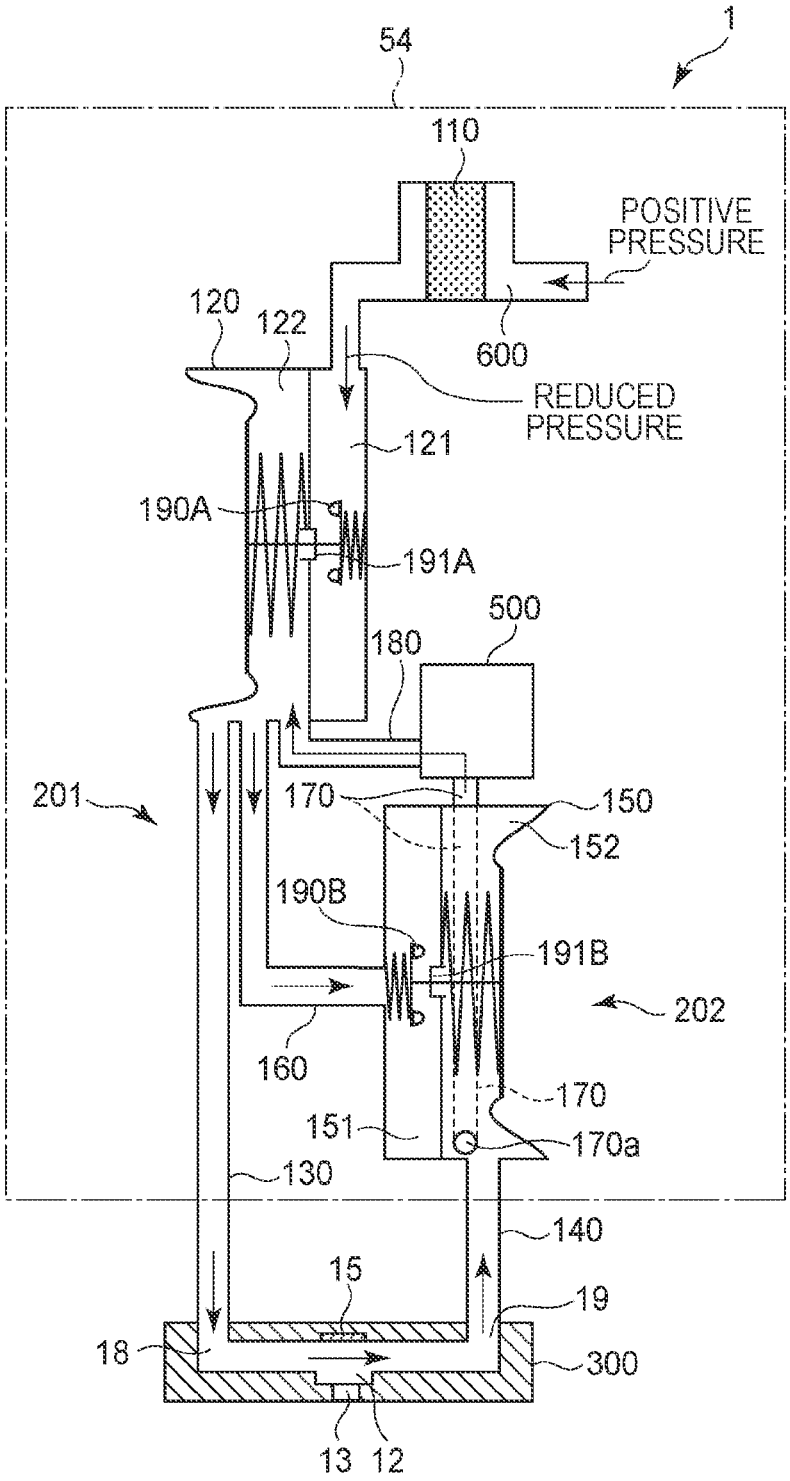
FIG. 12 is a longitudinal cross-sectional view of a circulation path.

As will be described below, in the case where the diaphragm pump 500 is installed in a liquid discharge apparatus, the intake hole 501 is connected to a pump inlet channel 170 (FIG. 12). The fluid collected through a collecting channel 140 (FIG. 12) is sucked into the diaphragm pump 500 through the pump inlet channel 170 and the intake hole 501. The discharge hole 502 is connected to a pump outlet channel 180 (FIG. 12), and the fluid discharged to the pump outlet channel 180 is supplied to a supply channel 130 (FIG. 12).

Figure 2:
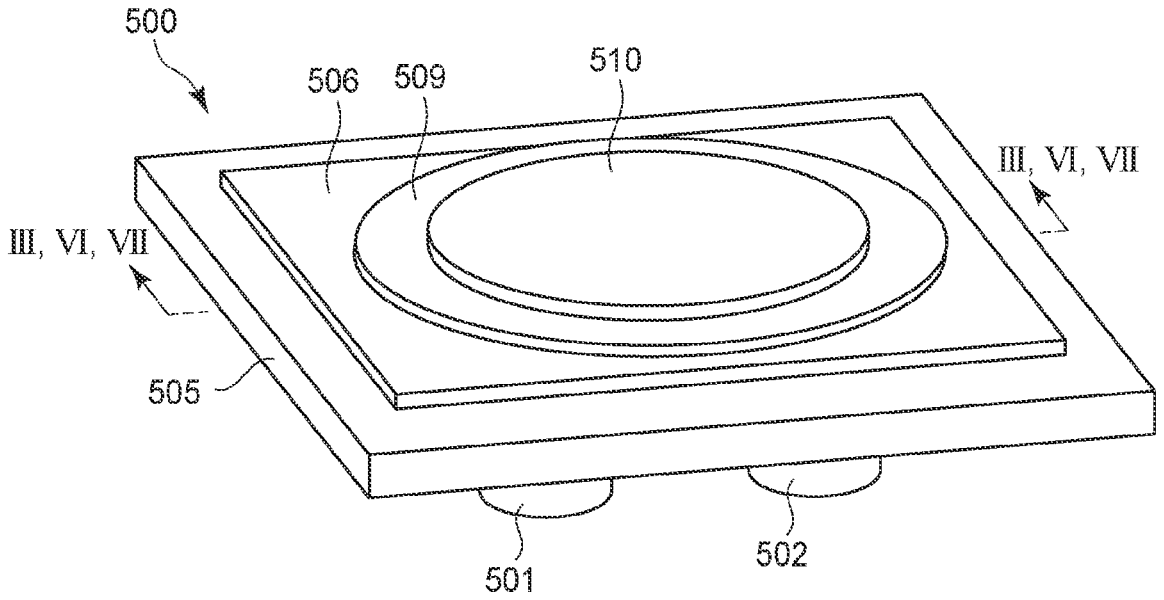
FIG. 2 is a perspective view of the diaphragm pump with its cover removed.

FIG. 2 is a perspective view of the diaphragm pump 500 with a cover 507 removed. The diaphragm pump 500 includes a diaphragm 506, an electrode plate 509, and a piezoelectric member 510 on a supporting member 505 in this order.

The piezoelectric member 510 has the function of converting applied electrical energy to mechanical energy. Applying a voltage to the piezoelectric member 510 causes the piezoelectric member 510 to change a shape of its form in response to the applied voltage. The diaphragm pump 500 is a pump that makes fluid flow by deforming the diaphragm 506 in response to the deformation of the piezoelectric member 510 subjected to a voltage.

The electrode plate 509 is disposed in contact with the piezoelectric member 510 to supply electric power to the piezoelectric member 510. The electrode plate 509 facilitates transmission of the vibration of the piezoelectric member 510 to the diaphragm 506. This enables the diaphragm 506 to vibrate greatly even if the piezoelectric member 510 is small in area. If a cable (not shown) for supplying electrical power to the piezoelectric member 510 is present separately from the electrode plate 509, the diaphragm pump 500 does not have to include the electrode plate 509.

Figure 3:
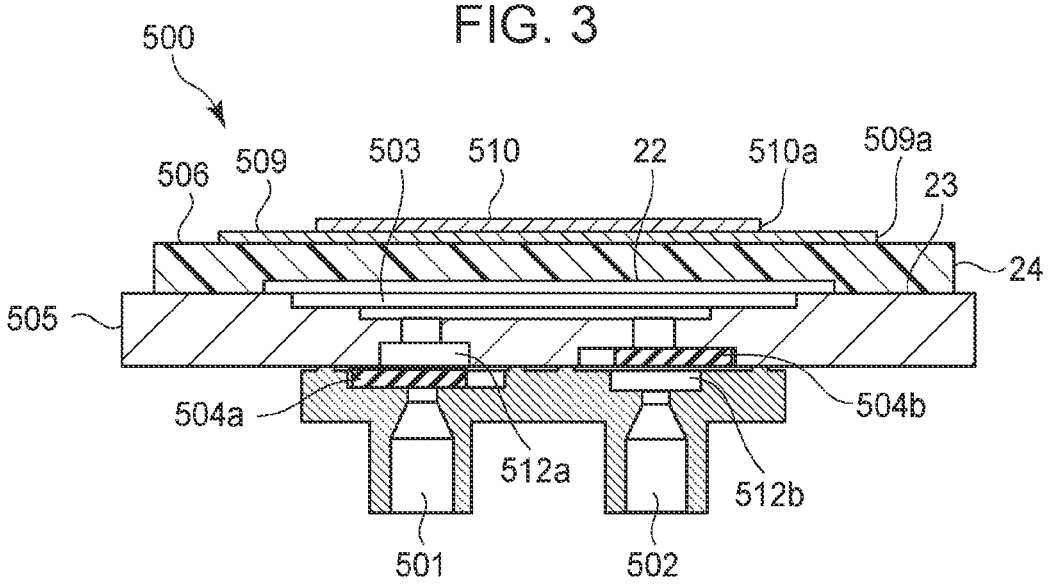
FIG. 3 is a cross-sectional view of the diaphragm pump.

The diaphragm 506 is a vibrating film that is deformed (vibrated) in response to the driving of the piezoelectric member 510 to increase or decrease the volume of a pump chamber 503 (FIG. 3). The diaphragm 506 is made of an injection-moldable material, such as denatured-polyphenyleether (PPE)+polystyrene (PS) or polypropylene. The diaphragm 506 may be a punched film or resin plate. The diaphragm 506 may be in a single layer or multiple layers.

The diaphragm 506 and the electrode plate 509, and the electrode plate 509 and the piezoelectric member 510 are individually bonded with an adhesive (not shown). The lower surface of the supporting member 505 has an intake hole 501 and a discharge hole 502. The intake hole 501 is a hole for sucking fluid from the upstream side into the pump chamber 503 (FIG. 3). The discharge hole 502 is a hole for discharging fluid downstream from the pump chamber 503.

Figure 4:
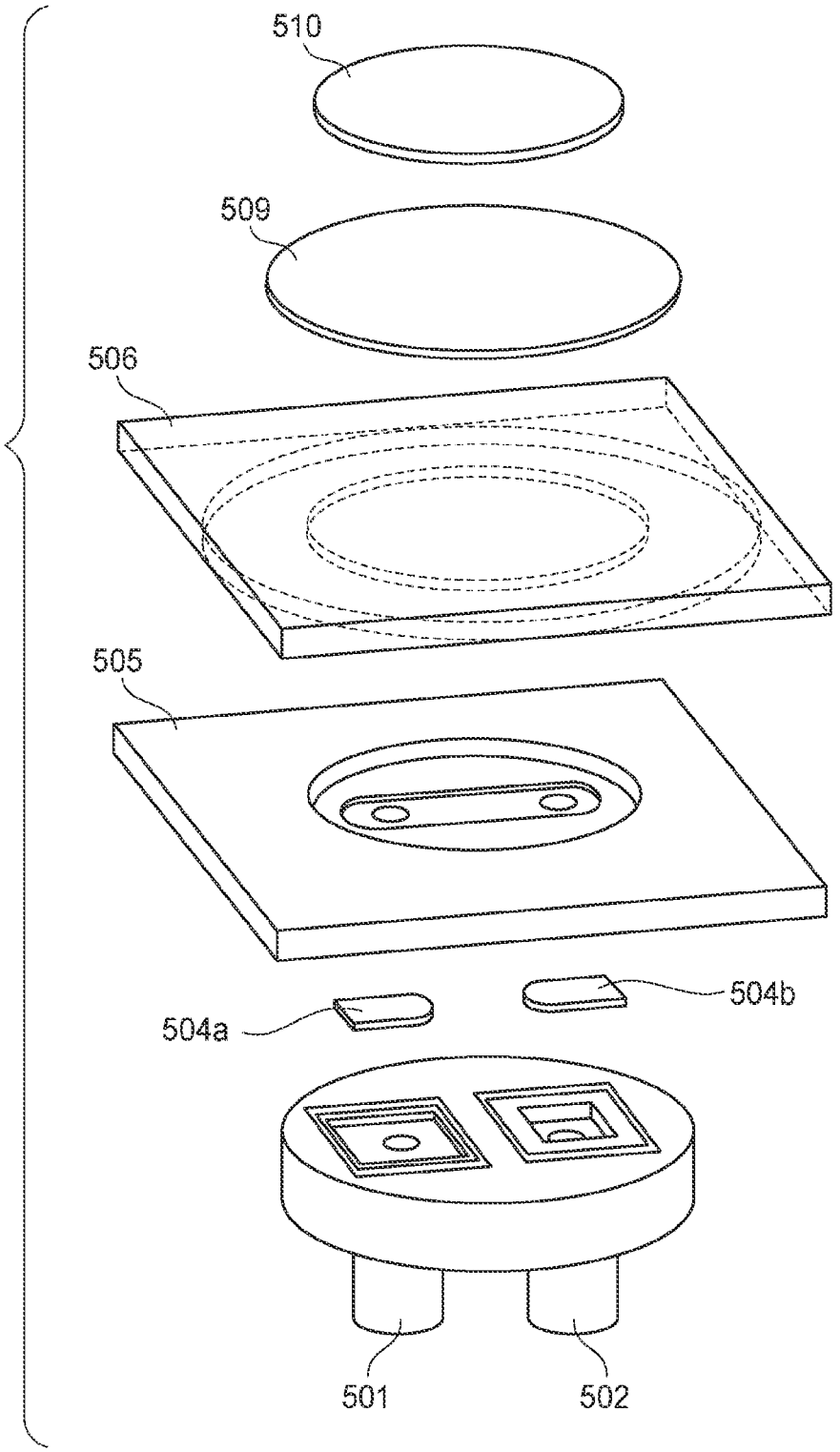
FIG. 4 is an exploded perspective view of the diaphragm pump.

FIG. 3 is a cross-sectional view of FIG. 2 taken along line III-III. FIG. 4 is an exploded perspective view of FIG. 2. The supporting member 505 has a circular recess 503 in the upper surface. The recess 503 is a space facing the diaphragm 506 and functions as the pump chamber 503. A check valve 504*a* is provided between the intake hole 501 and the pump chamber 503 (a communicating portion). A check valve 504*b* is provided between the pump chamber 503 and the discharge hole 502 (a communicating portion). The check valve 504*a* is a valve for preventing the fluid in a space 512*a* in the intake hole 501 from flowing (back) downward in the drawing. This allows the fluid in the space 512*a* to flow only to the pump chamber 503. The check valve 504*b* is a valve for preventing the fluid in a space 512*b* in the discharge hole 502 from flowing (back) to the pump chamber 503. This allows the fluid in the space 512*b* to flow only downward in the drawing.

Figure 5A:
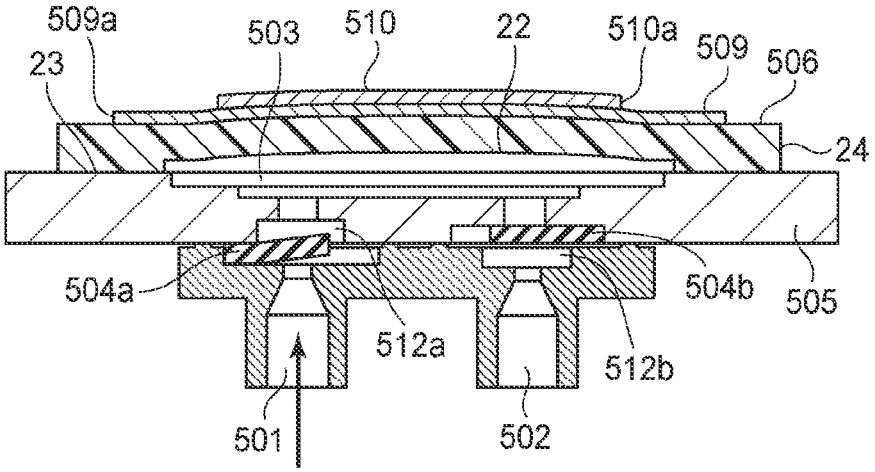
FIG. 5A is a diagram of the diaphragm pump at fluid intake.
Figure 5B:
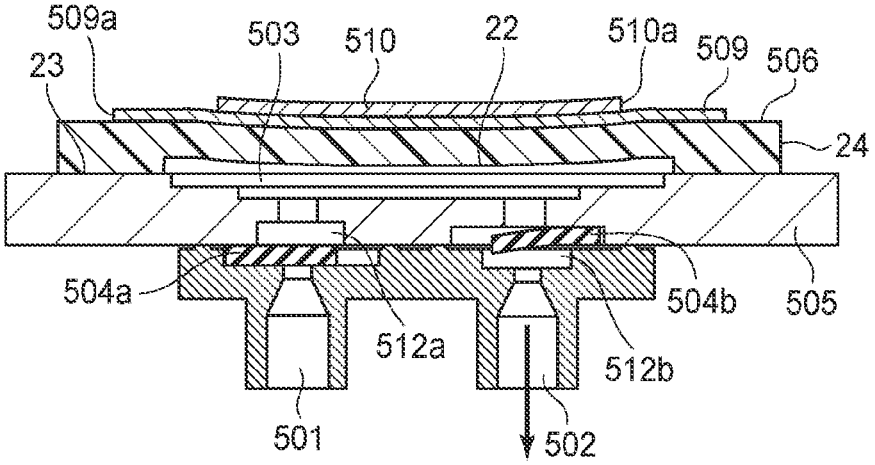
FIG. 5B is a diagram of the diaphragm pump at fluid discharge.

FIGS. 5A and 5B illustrate the diaphragm pump 500 in operation. Specifically, FIG. 5A illustrates the diaphragm pump 500 at fluid intake, and FIG. 5B illustrates the diaphragm pump 500 at fluid discharge. When the diaphragm 506 is displaced to increase the volume of the pump chamber 503, thereby decreasing the pressure in the pump chamber 503, the check valve 504*a* is separated from the opening of the intake hole 501 in the space 512*a* (moves upward in the drawing). The separation of the check valve 504*a* from the opening of the intake hole 501 in the space 512*a* causes the intake hole 501 to open so that the fluid can flow. When the diaphragm 506 is displaced to decrease the volume of the pump chamber 503, thereby increasing the pressure in the pump chamber 503, the check valve 504*a* comes into close-contact with the peripheral wall of the opening of the intake hole 501. This causes the intake hole 501 to be closed so that the flow of the fluid is blocked.

In contrast, when the pump chamber 503 is decompressed, the check valve 504*b* comes into close-contact with the peripheral wall of the opening of the supporting member 505 to close the discharge hole 502 so that the flow of the fluid is blocked.

When the pump chamber 503 is increased in pressure, the check valve 504*b* is separated from the opening of the supporting member 505 to move toward the space 512*b* (that is, downward in the drawing), thereby enabling the fluid to flow through the discharge hole 502.

The check valves 504*a* and 504*b* may be made of any material that is deformable in response to the pressure in the pump chamber 503. Examples include, but are not limited to, elastic members, such as ethylene propylene diene monomer (EPDM) and elastomer, and a polypropylene film or thin sheet.

The pump chamber 503 is formed by bonding the supporting member 505 and the diaphragm 506, as described above. Accordingly, the pressure in the pump chamber 503 is changed by deformation of the diaphragm 506. For example, when the diaphragm 506 is displaced toward the supporting member 505 (downward in the drawing) to decrease the volume of the pump chamber 503, the pressure in the pump chamber 503 increases.

This causes the check valve 504*b* opposed to the discharge hole 502 to be opened, thereby discharging the fluid in the pump chamber 503. At that time, the check valve 504*a* opposed to the intake hole 501 comes into close-contact with the peripheral wall of the intake hole 501, thereby preventing the fluid from flowing from the pump chamber 503 back to the intake hole 501.

In contrast, when the diaphragm 506 is displaced toward the piezoelectric member 510 (upward in the drawing) to increase the volume of the pump chamber 503, the pressure in the pump chamber 503 decreases. This causes the check valve 504*a* opposed to the intake hole 501 to be opened, thereby supplying the fluid to the pump chamber 503. At that time, the check valve 504*b* disposed at the discharge hole 502 comes into close-contact with the peripheral wall of the opening of the supporting member 505 to close the opening. This prevents the fluid from flowing from the discharge hole 502 back to the pump chamber 503.

Thus, the diaphragm pump 500 sucks and discharges fluid by deforming the diaphragm 506 to change the pressure in the pump chamber 503. However, even if the diaphragm 506 is deformed at the sucking and discharging of fluid, entrainment of bubbles in the pump chamber 503 decreases the pressure change in the pump chamber 503 because of expansion and contraction of the bubbles. The decrease in pressure change reduces the amount of fluid sucked and discharged.

Accordingly, to facilitate gathering the bubbles to the upper part of the pump chamber 503, the pump chamber 503 may be extended in the vertical direction in the orientation in which the diaphragm pump 500 is in use. The vertical direction in this embodiment may be at any angle at which bubbles can gather to the upper part of the pump chamber 503. The term "orientation in use" refers to an orientation in which the diaphragm pump 500 is used to serve as a pump, that is, the state in FIGS. 1A to 1C. The discharge hole 502 may be disposed above the intake hole 501 to discharge the bubbles in the pump chamber 503. The discharge hole 502 may be disposed above the center of the pump chamber 503 in the vertical direction to facilitate discharging the bubbles through the discharge hole 502. This allows stabilization of the flow rate of the diaphragm pump 500.

In this embodiment, a surface of the diaphragm 506 adjacent to the pump chamber includes a flat vibration surface 22 (also referred to as "first surface") and a protrusion 24 protruding at a certain height to bond to the upper surface of the supporting member 505. A surface of the protrusion 24 bonding to the supporting member 505 is referred to as a second surface 23. In other words, if the direction in which the volume of the space of the pump chamber 503 decreases, of the direction in which the first surface 22 is deformed, is from above to below, the second surface 23 is located lower than the first surface 22.

Thus, the first surface 22 and the second surface 23, which is a bonding surface, are different surfaces that are not bonded. For this reason, even if the electrode plate 509 is deformed by the driving of the piezoelectric member 510 to vibrate the diaphragm 506, the effect of the moment due to the vibration on the second surface 23 is reduced.

Furthermore, a projection of the outer peripheral edge 509*a* of the electrode plate 509 to the supporting member 505 may be within the bonded area (the second surface 23) between the diaphragm 506 and the supporting member 505. This decreases the distance between the outer peripheral edge 509*a* of the electrode plate 509 and the bonded area in the direction perpendicular to the vibrating direction of the diaphragm 506, thereby further reducing the effect of the moment due to the vibration.

In the above description, the diaphragm pump 500 includes the diaphragm 506, the electrode plate 509, and the piezoelectric member 510 laminated on the supporting member 505 in this order. Alternatively, the electrode plate 509 may be omitted. In other words, the diaphragm 506 may be directly bonded to the piezoelectric member 510. In this case also, bonding the second surface 23 different from the first surface 22 to the supporting member 505 allows the effect of the moment due to the vibration at the joint portion to be reduced. The projection of the outer peripheral edge 510*a* of the piezoelectric member 510 to the diaphragm 506 may be disposed in the second surface. This reduces the distance between the outer peripheral edge 510*a* of the piezoelectric member 510 and the joint area in the direction perpendicular to the vibrating direction of the diaphragm 506, further reducing the effect of the moment due to the vibration.

In FIGS. 5A and 5B, the second surface 23 protrudes more than the first surface 22 with respect to the supporting member 505. The second surface 23 may be recessed more than the first surface 22 with respect to the supporting member 505. In other words, if the direction in which the volume of the space of the pump chamber 503 decreases, of the direction in which the first surface 22 is deformed, is from above to below, the second surface 23 may be located either lower than the first surface 22 or higher than the first surface 22. In other words, the first surface 22 and the second surface 23 may be any different surfaces that are not directly connected to each other.

With the above configuration, the vibration surface 22 of the diaphragm 506 and the joint surface 23 are different surface that are not directly connected to each other. This prevents a decrease in the bonding strength of the diaphragm 506 and the supporting member 505 to be reduced.

Second Embodiment

The configuration of a diaphragm pump according to a second embodiment of the present disclosure will be described. In the following description, difference from the first embodiment will be mainly described, and descriptions of the same as the components of the first embodiment will be omitted.

Figure 6:
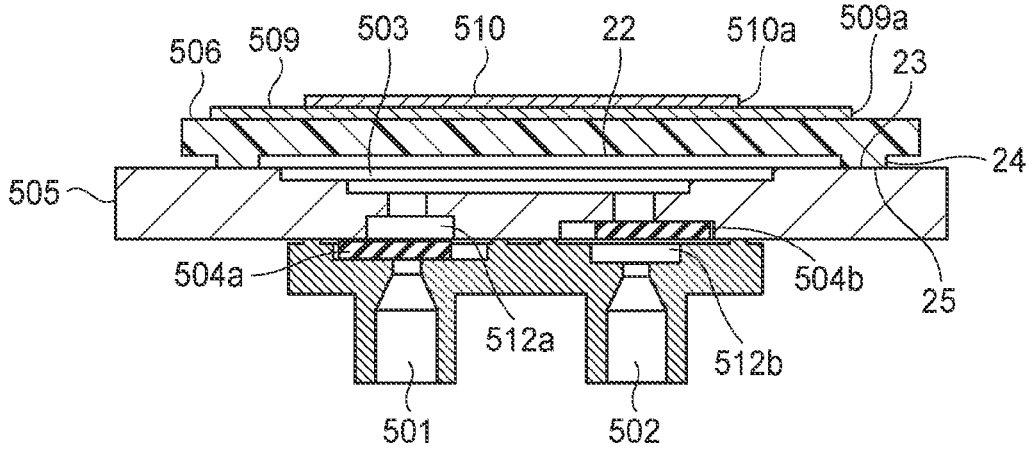
FIG. 6 is a cross-sectional view of a diaphragm pump of a second embodiment.

FIG. 6 is a cross-sectional view of a diaphragm pump of the second embodiment taken along line VI-VI in FIG. 2. In the second embodiment, a surface of the diaphragm 506 bonded to the piezoelectric member 510 or the electrode plate 509 extends outward more than the second surface 23. In the VI-VI cross-sectional view, one of the projections of the outer peripheral edge 509*a* of the electrode plate 509 to the diaphragm is in the joint area (the second surface 23) of the diaphragm 506 and the supporting member 505, and the other is outside the joint area. In other words, the center of the electrode plate 509 and the center of the diaphragm 506 are not aligned in the direction parallel to the supporting member 505. In other words, the center of the electrode plate 509 is off the center of the diaphragm 506 as seen from the direction perpendicular to the first surface 22 of the diaphragm 506. Such right-left asymmetrical misalignment is due to tolerance in assembling the diaphragm pump 500 or component tolerance. Even with such misalignment, one of the projections of the outer peripheral edge 509*a* of the electrode plate 509 to the diaphragm 506 in the VI-VI cross-sectional view is disposed in the second surface 23. This prevents a decrease in the bonding strength of the diaphragm 506 and the supporting member 505.

Without the electrode plate 509, the center of the piezoelectric member 510 may be off the center of the diaphragm 506 as seen from the direction perpendicular to the first surface 22 of the diaphragm 506.

In this case, one of the projections of the outer peripheral edge 510*a* of the piezoelectric member to the diaphragm is disposed in the second surface in the cross-sectional view taken along line VI-VI in FIG. 2, as with the electrode plate 509. This prevents a decrease in the bonding strength of the diaphragm 506 and the piezoelectric member 510.

With the above configuration, even with such right-left asymmetrical misalignment, the effect of the moment applied to the second surface 23 can be reduced, as in the first embodiment, because the first surface 22 and the second surface 23 are different surfaces that are not connected to each other.

Example 1

Figure 7:
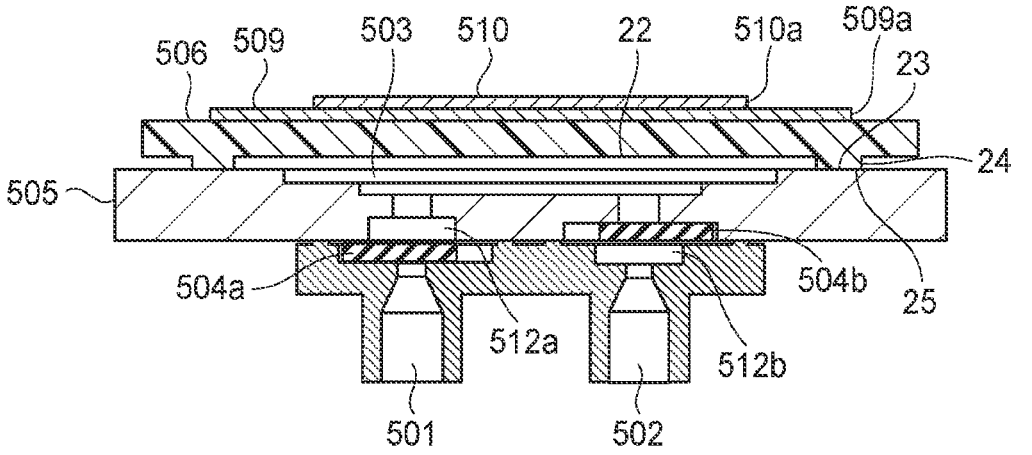
FIG. 7 is a cross-sectional view OF a diaphragm pump in Example 1.

Example 1 will be described as follows. FIG. 7 is a cross-sectional view OF a diaphragm pump in Example 1 taken along line VII-VII in FIG. 2. In this example, the supporting member 505 is made of a laser-light transmissive material, and the diaphragm 506 is made of a laser-light absorptive material. The diaphragm 506 is bonded to the supporting member 505 using laser welding. Applying laser light from the supporting member 505 side only to the second surface 23, with the second surface 23 and the supporting member 505 in close-contact with each other, can prevent the thermal effect of laser welding on the first surface 22.

In this example, the width of the joint area 25 of the second surface 23 was set to 0.5 mm before laser welding and 1 mm after the laser welding. The height of the protrusions 24 including the second surface 23 was set to 0.15 mm before the laser welding and set to 0.05 mm after the laser welding. The outside diameter ϕ of the electrode plate 509 was set to 20 mm. As shown in FIG. 7, the projection of the outer peripheral edge 509*a* of the electrode plate 509 to the supporting member 505 was set within the joint area 25 of the diaphragm 506 and the supporting member 505. The outside diameter ϕ of the electrode plate 509 was set to 20 mm.

Liquid Discharge Apparatus

A liquid discharge apparatus equipped with a liquid discharge head 1 including the diaphragm pump 500 of the above embodiments will be described. This embodiment will be described using an example employing a thermal method for discharging liquid by generating air bubbles with an electrothermal converting element as a liquid discharge element, but this is given for mere illustrative purposes. The present disclosure may be applied to a liquid discharge head that employs a discharge method for discharging liquid using a piezoelectric element or another discharge method. The configurations of the pressure adjusting unit and so on described below are also not limited to the configurations described in the embodiments and the drawings.

Figure 8A:
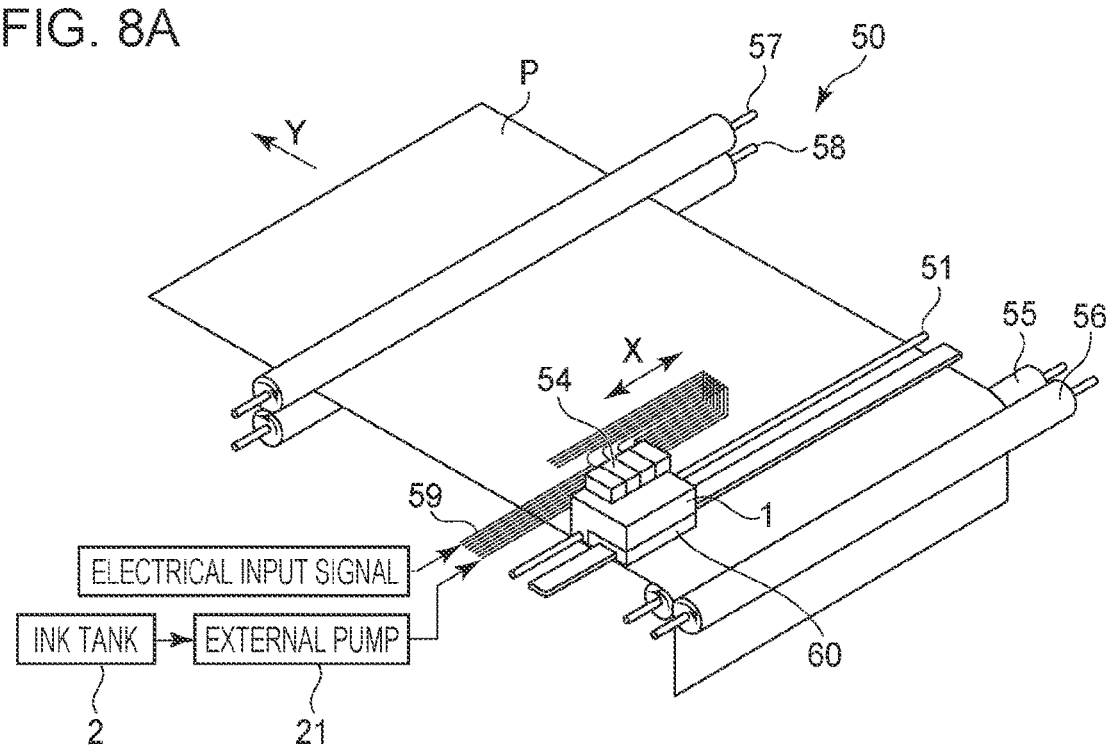
FIG. 8A is a perspective view of a liquid discharge apparatus.
Figure 8B:
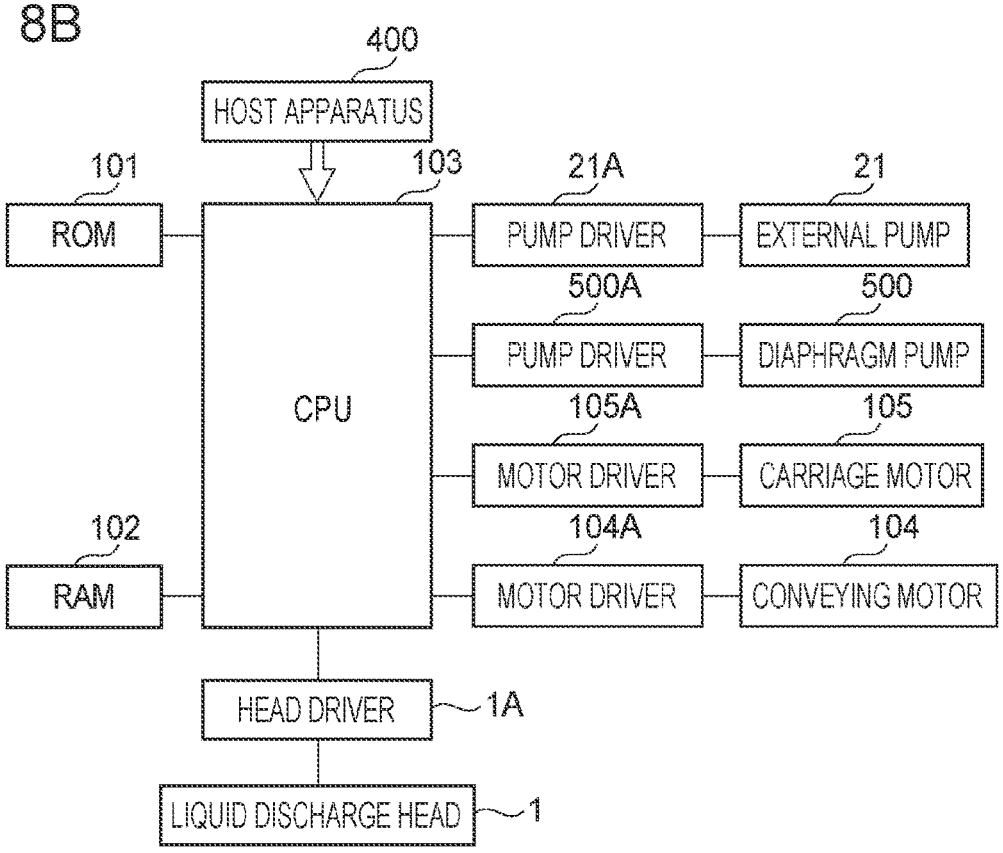
FIG. 8B is a block diagram illustrating the liquid discharge apparatus.

FIGS. 8A and 8B are diagrams for illustrating the liquid discharge apparatus, illustrating the liquid discharge head and the peripherals of the liquid discharge apparatus in enlarged view. First, the schematic configuration of a liquid discharge apparatus 50 of this embodiment will be described with reference to FIGS. 8A and 8B. FIG. 8A is a schematic perspective view of the liquid discharge apparatus 50 including a liquid discharge head 1. The liquid discharge apparatus 50 of this embodiment is a serial ink-jet recording apparatus that discharges ink, or liquid, while moving the liquid discharge head 1 to record on a recording medium P. Another example is a what-is-called full-line liquid discharge head including discharge ports across the width of the recording medium P so as to be capable of discharge across the width of the recording medium P without moving in a main scanning direction, described below.

The liquid discharge head 1 is mounted on a mount (a carriage 60). The carriage 60 moves back and forth in the main scanning direction (X-direction) along a guide shaft 51. The recording medium P is conveyed in a sub-scanning direction (Y-direction) intersecting (in this example, at right angles) the main scanning direction by conveying rollers 55, 56, 57, and 58. In the following drawings, the Z-direction is the vertical direction and intersecting (in this embodiment, at right angles) an X-Y plane defined by the X-direction and the Y-direction. The liquid discharge head 1 is detachably attached to the carriage 60 by the user.

The liquid discharge head 1 includes a circulation unit 54 and a discharge unit 3 (see FIG. 9), described below. The discharge unit 3 includes a plurality of discharge ports for discharging liquid and discharge elements that generate discharge energy for discharging liquid from the individual discharge ports, the specific configuration of which will be described below.

The liquid discharge apparatus 50 includes an ink tank 2, which is an ink supply source, and an external pump 21. The ink stored in the ink tank 2 is supplied to the circulation unit 54 through an ink supply tube 59 by the driving force of the external pump 21.

The liquid discharge apparatus 50 forms a predetermined image on the recording medium P by repeating a recording scanning operation in which the liquid discharge head 1 mounted on the carriage 60 discharges ink while moving in the main scanning direction and a conveying operation of conveying the recording medium P in the sub-scanning direction. The liquid discharge head 1 of this embodiment is capable of discharging four kinds of ink, black (K), cyan (C), magenta (M), and yellow (Y), and can record a full-color image with the inks. The ink that the liquid discharge head 1 can discharge is not limited to the above four kinds of ink. The present disclosure is also applicable to liquid discharge heads for discharging other kinds of ink. In other words, the kind and number of ink discharged from the liquid discharge head are not limited.

The liquid discharge apparatus 50 includes a cap (not shown), at a position out of the conveying path of the recording medium P in the X-direction, capable of covering a discharge port surface in which the discharge ports of the liquid discharge head 1 are formed. The cap covers the discharge port surface of the liquid discharge head 1 in non-print operation to prevent the discharge ports from drying, protect the discharge ports, and suck the ink from the discharge ports.

The liquid discharge head 1 shown in FIG. 8A includes four circulation units 54 for four kinds of ink. Alternatively, the liquid discharge head 1 may include circulation units 54 according to the kinds of discharge liquid. A plurality of circulation units 54 may be provided for the same kind of liquid. In other words, the liquid discharge head 1 may include one or more circulation units. Not all of four kinds of ink, but at least one kind of ink may be circulated.

FIG. 8B is a block diagram illustrating the control system of the liquid discharge apparatus 50. A central processing unit (CPU) 103 functions as a controller for controlling the operation of the components of the liquid discharge apparatus 50 on the basis of programs, such as a processing procedure, stored in a read-only memory (ROM) 101. A random-access memory (RAM) 102 is used as a work area used when the CPU 103 executes processes. The CPU 103 receives image data from a host apparatus 400 outside the liquid discharge apparatus 50 and controls a head driver 1A to control the driving of the discharge elements provided in the discharge unit 3. The CPU 103 also controls drivers of various actuators provided in the liquid discharge apparatus 50. For example, the CPU 103 controls a motor driver 105A for a carriage motor 105 for moving the carriage 60 and a motor driver 104A for a conveying motor 104 for conveying the recording medium P. The CPU 103 also controls a pump driver 500A for driving the diaphragm pump 500, described below, and a pump driver 21A for the external pump 21. FIG. 8B shows a configuration for a process of receiving image data from the host apparatus 400. Alternatively, the liquid discharge apparatus 50 may execute a process not based on data from the host apparatus 400.

Basic Configuration of Liquid Discharge Head

Figure 9:
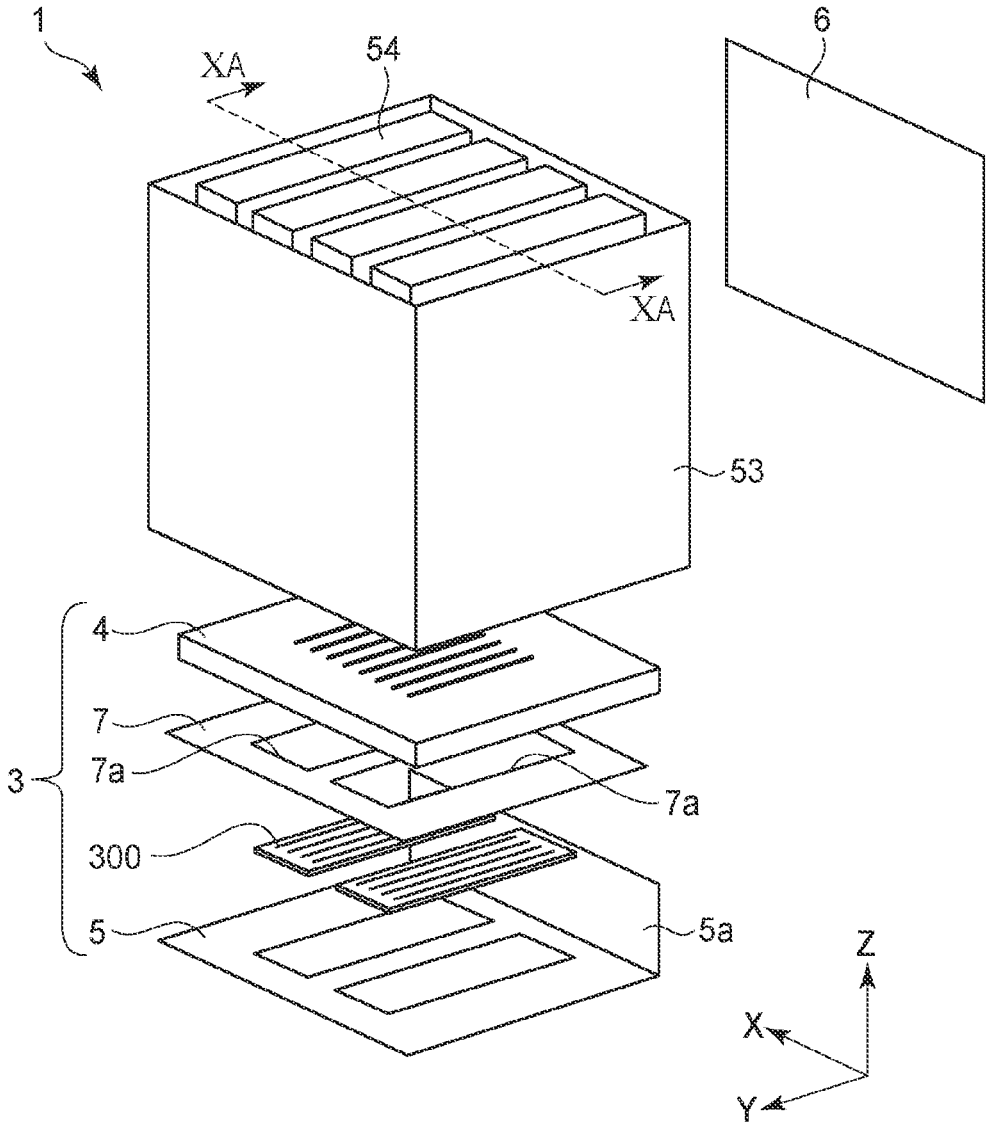
FIG. 9 is an exploded perspective view of a liquid discharge head.
Figure 10A:
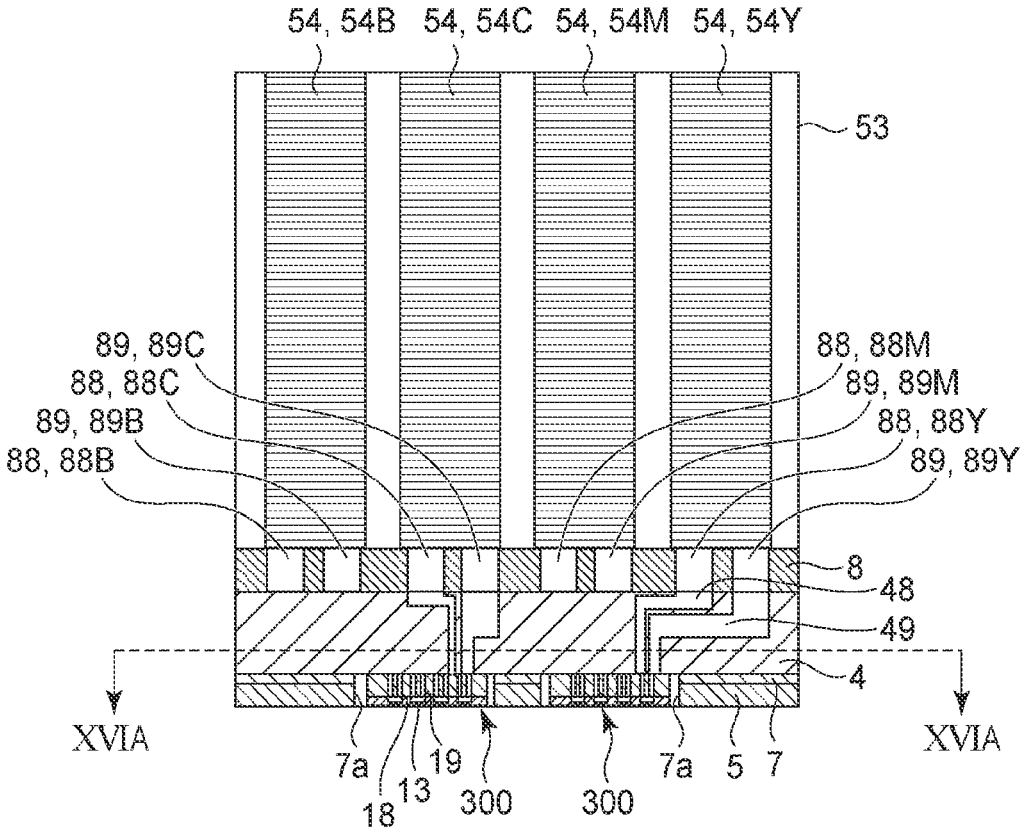
FIG. 10A is a cross-sectional view of the liquid discharge head.
Figure 10B:
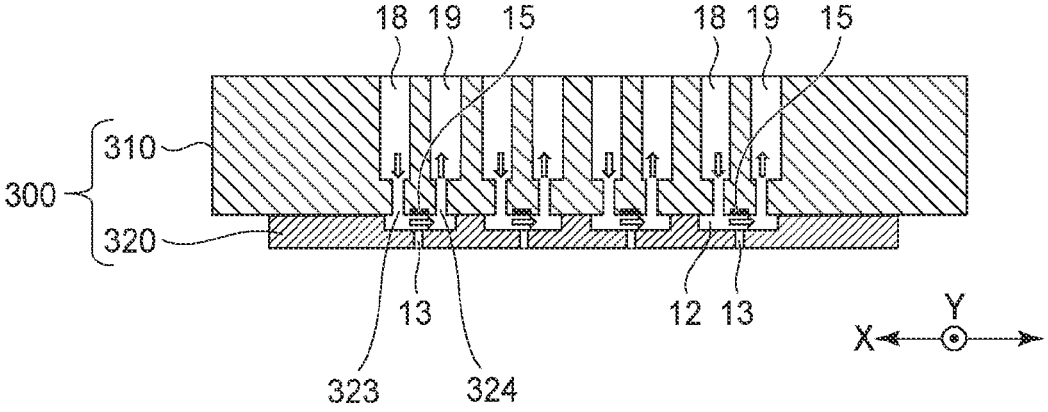
FIG. 10B is an enlarged view of a discharge module.

FIG. 9 is an exploded perspective view of the liquid discharge head 1 of this embodiment. FIG. 10A is a cross-sectional view of the liquid discharge head 1 in FIG. 9 taken along line XA-XA. FIG. 10A is an overall longitudinal cross-sectional view of the liquid discharge head 1. FIG. 10B is an enlarged view of a discharge module 300 shown in FIG. 10A.

The basic configuration of the liquid discharge head 1 of this embodiment will be described hereinbelow mainly with reference to FIG. 9 and FIGS. 10A and 10B, as well as FIG. 8A as appropriate.

As shown in FIG. 9, the liquid discharge head 1 includes the circulation unit 54 and the discharge unit 3 for discharging the ink supplied from the circulation unit 54 onto the recording medium P. The liquid discharge head 1 of this embodiment is fixed and supported by the carriage 60 with a positioning unit and electrical contact (not shown) provided at the carriage 60 of the liquid discharge apparatus 50. The liquid discharge head 1 records on the recording medium P by discharging ink while moving in the main scanning direction (X-direction), shown in FIG. 8A, together with the carriage 60.

The external pump 21 connected to the ink tank 2 serving as an ink supply source is provided with the ink supply tube 59 (see FIG. 8A). The ink supply tube 59 has a liquid connector (not shown) at the distal end. When the liquid discharge head 1 is installed in the liquid discharge apparatus 50, the liquid connector provided at the distal end of the ink supply tube 59 is airtightly connected to a liquid-connector insertion slot 53*a* in the head casing 53 of the liquid discharge head 1. Thus, an ink supply channel extending from the ink tank 2 through the external pump 21 to the liquid discharge head 1 is formed. Since this embodiment uses four kinds of ink, four sets of the ink tank 2, the external pump 21, the ink supply tube 59, and the circulation unit 54 are provided for the individual inks, and four ink supply channels for the individual inks are independently provided. Thus, the liquid discharge apparatus 50 of this embodiment is equipped with an ink supply system in which ink is supplied from the ink tank 2 provided outside the liquid discharge head 1. The liquid discharge apparatus 50 of this embodiment does not include an ink collecting system for collecting the ink in the liquid discharge head 1 into the ink tank 2. Accordingly, the liquid discharge head 1 includes the liquid-connector insertion slot 53*a* for connecting the ink supply tube 59 of the ink tank 2 but does not include a connector insertion slot for connecting a tube for collecting the ink in the liquid discharge head 1 into the ink tank 2. The liquid-connector insertion slot 53*a* is provided for each ink.

In FIG. 10A, reference sign 54B denotes a black-ink circulation unit, 54C denotes a cyan-ink circulation unit, 54M denotes a magenta-ink circulation unit, and 54Y denotes a yellow-ink circulation unit. The circulation units 54B, 54C, 54M, and 54Y have substantially the same configuration. The circulation units 54B, 54C, 54M, and 54Y are all referred to as "circulation unit 54" in this embodiment when no particular distinction is made.

In FIGS. 9 and 10A, the discharge unit 3 includes two discharge modules 300, a first supporting member 4, a second supporting member 7, an electrical wiring member (electrical wiring tape) 5, and an electrical contact substrate 6. As shown in FIG. 10B, each discharge module 300 includes a silicon substrate 310 with a thickness of 0.5 to 1 mm and a plurality of discharge elements 15 provided on one surface of the silicon substrate 310. The discharge elements 15 of this embodiment are electrothermal conversion elements (heaters) that generate thermal energy as discharge energy for discharging liquid. Each discharge element 15 is supplied with electrical power through an electrical wiring line formed on the silicon substrate 310 using a deposition technique.

A discharge-port formed member 320 is provided on a surface (the lower surface in FIG. 10B) of the silicon substrate 310. The discharge-port formed member 320 has a plurality of pressure chambers 12 corresponding to the plurality of discharge elements 15 and a plurality of discharge ports 13 formed using a photolithography technique. The pressure chambers 12 are spaces where energy generated by the individual discharge elements 15 acts. The silicon substrate 310 further includes common supply channels 18 and common collecting channels 19. The silicon substrate 310 further includes supply connecting channels 323 each communicating between the common supply channel 18 and the pressure chamber 12 and collection connecting channels 324 each communicating between the common collecting channel 19 and the pressure chamber 12. In this embodiment, one discharge module 300 discharges two kinds of ink. In other words, of the two discharge modules 300 shown in FIG. 10A, the discharge module 300 at the left in the drawing discharges black ink and cyan ink, and the discharge module 300 at the right in the drawing discharges magenta ink and yellow ink. This combination is illustrative only, and any other combination of ink is possible. One discharge module may discharge one kind of ink or three kinds or more of ink. The two discharge modules 300 do not have to discharge the same number of kinds of ink. The discharge unit 3 may include one discharge module 300 or three or more discharge modules 300. In the example shown in FIGS. 10A and 10B, two discharge port arrays extending in the Y-direction are provided for one color ink. The pressure chamber 12, the common supply channels 18, and the common collecting channels 19 are provided for each of the plurality of discharge ports 13 constituting each discharge port array.

The silicon substrate 310 includes an ink supply port and an ink collecting port, described below, on the back (the upper surface in FIG. 10B). The ink supply port is used to supply ink to the plurality of common supply channels 18 from an ink supply channel 48. The ink collecting port is used collect the ink to an ink collecting channel 49 from the plurality of common collecting channels 19.

The ink supply port and the ink collecting port in this case refer to openings for use in supplying and collecting ink in forward ink circulation. In other words, the forward ink circulation supplies the ink from the ink supply port to the common supply channels 18 and collects the ink from the common collecting channels 19 to the ink collecting port. Backward ink circulation can also be performed. In this case, the ink is supplied from the ink collecting port, described above, to the common collecting channels 19 and is collected from the common supply channels 18 to the ink supply port.

As shown in FIG. 10A, the back (the upper surface in FIG. 10A) of the discharge module 300 is bonded and fixed to one surface (the lower surface in FIG. 10A) of the first supporting member 4. The first supporting member 4 includes the ink supply channel 48 and the ink collecting channel 49 passing therethrough from one surface to the other surface. One opening of the ink supply channel 48 communicates with the above-described ink supply port of the silicon substrate 310, and the other opening of the ink collecting channel 49 communicates with the above-described ink collecting port of the silicon substrate 310. The ink supply channel 48 and the ink collecting channel 49 are provided independently for each kind of ink.

The second supporting member 7 having an opening 7*a* (see FIG. 9) through which the discharge module 300 is passed is bonded and fixed to one surface (the lower surface in FIG. 10A) of the first supporting member 4. The second supporting member 7 holds an electrical wiring member 5 electrically connected to the discharge module 300. The electrical wiring member 5 is a member for applying an electrical signal for discharging ink to the discharge module 300. The electrical connection between the discharge module 300 and the electrical wiring member 5 is sealed with a sealing material (not shown), thereby being protected against ink corrosion and external impact.

An electrical contact substrate 6 is thermally compressed to an end 5*a* of the electrical wiring member 5 (see FIG. 9) using anisotropically-conductive film (not shown), so that the electrical wiring member 5 and the electrical contact substrate 6 are electrically connected. The electrical contact substrate 6 includes an external-signal input terminal (not shown) for receiving an electrical signal from the liquid discharge apparatus 50.

A joint member 8 (FIG. 10A) is provided between the first supporting member 4 and the circulation unit 54. The joint member 8 includes a supply port 88 and a collection port 89 for each kind of ink. The supply port 88 and the collection port 89 communicate between the ink supply channel 48 and the ink collecting channel 49 of the first supporting member 4 and the channels in the circulation unit 54. In FIG. 10A, the supply port 88B and the collection port 89B are provided for black ink, and the supply port 88C and the collection port 89C are provided for cyan ink. The supply port 88M and the collection port 89M are provided for magenta ink, and the supply port 88Y and the collection port 89Y are for yellow ink.

The opening at one end of each of the ink supply channel 48 and the ink collecting channels 49 of the first supporting member 4 has a small opening area fitted to the ink supply port and the ink collecting port of the silicon substrate 310, respectively. In contrast, the opening at the other end of each of the ink supply channel 48 and the ink collecting channels 49 of the first supporting member 4 has a shape with the same area as the large opening area of the joint member 8 formed so as to be fitted to the channel in the circulation unit 54. This configuration prevents an increase in channel resistance to the ink collected through the collecting channels. However, the shapes of the openings at one end and the other end of the ink supply channel 48 and the ink collecting channels 49 are not limited to the above examples.

In the liquid discharge head 1 with the above configuration, the ink supplied to the circulation unit 54 passes through the supply port 88 of the joint member 8 and the ink supply channel 48 of the first supporting member 4 and flows into the common supply channel 18 via the ink supply port of the discharge module 300. The ink subsequently flows from the common supply channel 18 into the pressure chamber 12 through the supply connecting channel 323, and part of the ink flowing into the pressure chamber 12 is discharged from the discharge port 13 by the driving of the discharge element 15. Remaining ink that has not discharged passes through the pressure chamber 12, the collection connecting channel 324, and the common collecting channel 19 and flows into the ink collecting channel 49 of the first supporting member 4 via the ink collecting port. The ink flowing into the ink collecting channel 49 flows into the circulation unit 54 for collection through the collection port 89 of the joint member 8.

Components of Circulation Unit

Figure 11:
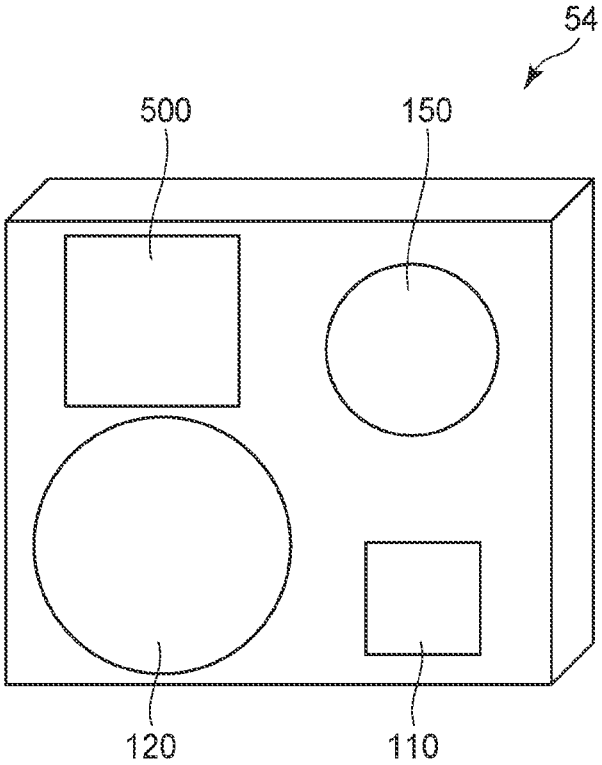
FIG. 11 is a schematic external view of a circulation unit.
Figure 13:
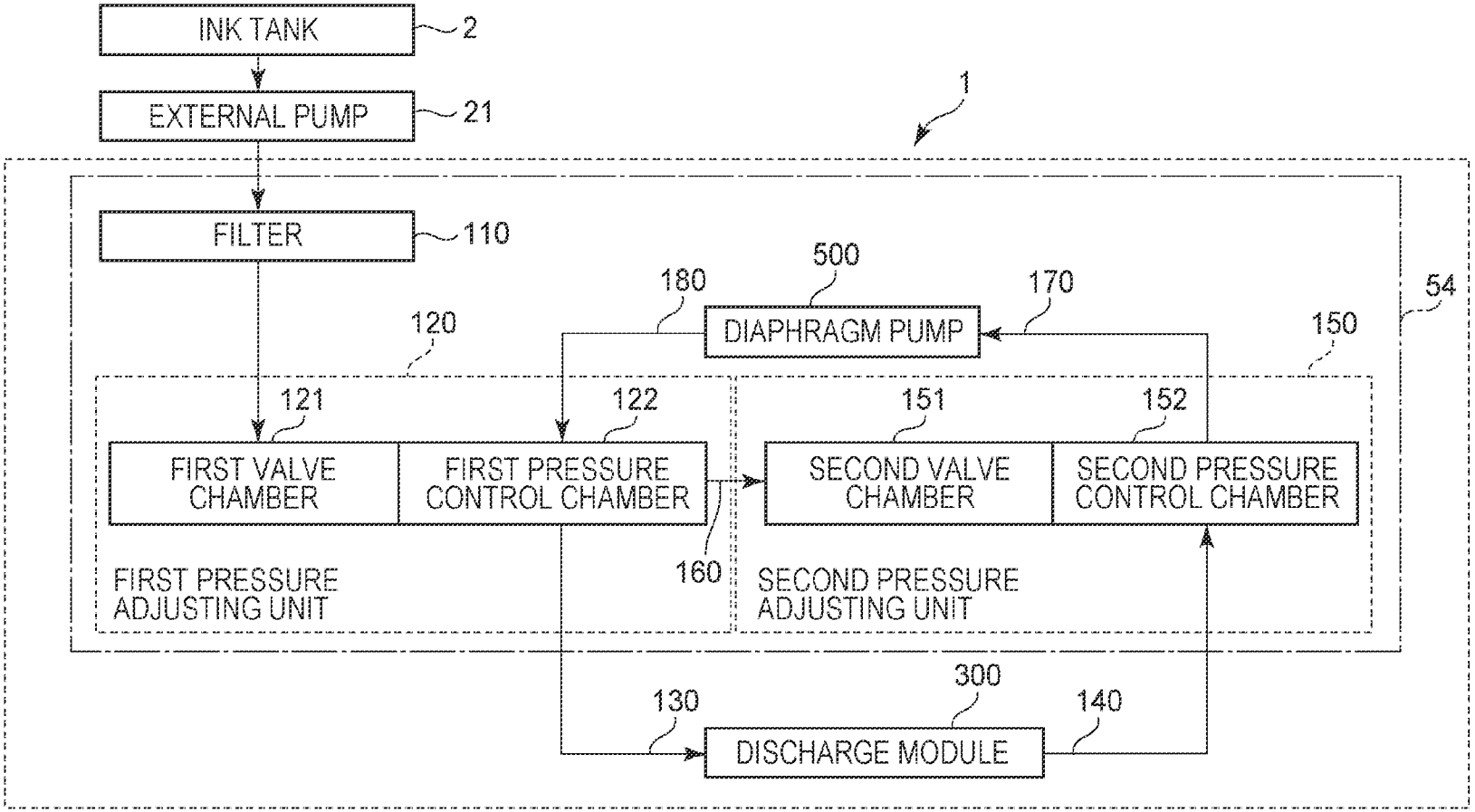
FIG. 13 is a schematic block diagram of the circulation path.

FIG. 11 is a schematic external view of one circulation unit 54 for one kind of ink applied to the recording apparatus of this embodiment. The circulation unit 54 includes a filter 110, a first pressure adjusting unit 120, a second pressure adjusting unit 150, and the diaphragm pump 500. These components are connected with channels as shown in FIGS. 12 and 13 to constitute a circulation path for supplying and collecting ink to and from the discharge module 300 in the liquid discharge head 1.

Circulation Path in Liquid Discharge Head

FIG. 12 is a schematic longitudinal cross-sectional view of the circulation path of one kind of ink (one-color ink) configured in the liquid discharge head 1. FIG. 13 is a schematic block diagram of the circulation path shown in FIG. 12. As shown in FIGS. 12 and 13, the first pressure adjusting unit 120 includes a first valve chamber 121 and a first pressure control chamber 122. The second pressure adjusting unit 150 includes a second valve chamber 151 and a second pressure control chamber 152. The first pressure adjusting unit 120 is configured to have higher control pressure than that of the second pressure adjusting unit 150. This embodiment enables circulation in a fixed pressure range in the circulation path by using the two pressure adjusting units 120 and 150. This embodiment is configured so that ink flows through the pressure chamber 12 (discharge element 15) at a flow rate according to the pressure difference between the first pressure adjusting unit 120 and the second pressure adjusting unit 150. Referring to FIGS. 12 and 13, the circulation path in the liquid discharge head 1 and the flow of ink in the circulation path will be described hereinbelow. The arrows in the drawings indicate directions in which the ink flows.

First, the connection status of the components of the liquid discharge head 1 will be described. The external pump 21 that pumps the ink contained in the ink tank 2 (FIG. 13) provided outside the liquid discharge head 1 to the liquid discharge head 1 is connected to the circulation unit 54 via the ink supply tube 59 (FIG. 8A). An inflow channel 600 upstream in the circulation unit 54 includes the filter 110 and communicates with the first valve chamber 121 of the first pressure adjusting unit 120. That is, the inflow channel 600 connects to a first channel 201. The first valve chamber 121 communicates with the first pressure control chamber 122 via a communication port 191A which can be opened and closed by a valve 190A shown in FIG. 12.

The first pressure control chamber 122 is connected to a supply channel 130, a bypass channel 160, and a pump outlet channel 180 of the diaphragm pump 500. The supply channel 130 is connected to the common supply channel 18 via the above-described ink supply port in the discharge module 300.

The bypass channel 160 is connected to a second valve chamber 151 provided in the second pressure adjusting unit 150. The second valve chamber 151 communicates with the second pressure control chamber 152 via a communication port 191B which is opened and closed by a valve 190B shown in FIG. 12. FIGS. 12 and 13 show an example in which one end of the bypass channel 160 is connected to the first pressure control chamber 122 of the first pressure adjusting unit 120, and the other end of the bypass channel 160 is connected to the second valve chamber 151 of the second pressure adjusting unit 150. Alternatively, one end of the bypass channel 160 may be connected to the supply channel 130, and the other end of the bypass channel may be connected to the second valve chamber 151.

The second pressure control chamber 152 is connected to the collecting channel 140. The collecting channel 140 is connected to the common collecting channel 19 via the above-described ink collecting port provided in the discharge module 300. The second pressure control chamber 152 is connected to the diaphragm pump 500 via the pump inlet channel 170. In FIG. 12, reference sign 170*a* denotes the inflow port of the pump inlet channel 170.

Next, the flow of ink in the liquid discharge head 1 with the above configuration will be described. As shown in FIG. 13, the ink contained in the ink tank 2 is pressurized by the external pump 21 provided for the liquid discharge apparatus 50 into a positive-pressure ink flow and is supplied to the circulation unit 54 of the liquid discharge head 1.

The ink supplied to the circulation unit 54 passes through the filter 110 so that foreign materials and air bubbles are removed and flows into the first valve chamber 121 in the first pressure adjusting unit 120. The pressure of the ink is decreased because of a pressure loss when the ink passes through the filter 110 but is positive at this stage. Thereafter, the ink flowing into the first valve chamber 121 passes through the communication port 191A, when the valve 190A is opened, into the first pressure control chamber 122. The ink that flowing into the first pressure control chamber 122 is switched from the positive pressure to a negative pressure because of pressure loss when passing through the communication port 191A.

Next, the flow of the ink in the circulation path will be described. The diaphragm pump 500 is a pump that makes liquid flow by applying a voltage to the piezoelectric member 510 to vibrate the diaphragm 506, as described in the above embodiment. The diaphragm pump 500 operates so as to send the ink sucked from the upstream pump inlet channel 170 to the downstream pump outlet channel 180. The driving of the pump causes the ink supplied to the first pressure control chamber 122 to flow into the supply channel 130 and the bypass channel 160 together with the ink sent from the pump outlet channel 180.

The ink flowing into the supply channel 130 passes through the ink supply port of the discharge module 300 and the common supply channel 18 into the pressure chamber 12, and part of the ink is discharged from the discharge port 13 by the driving (heat generation) of the discharge element 15. Remaining ink not used for discharge flows through the pressure chamber 12 and the common collecting channel 19 into the collecting channel 140 connected to the discharge module 300. The ink flowing into the collecting channel 140 flows into the second pressure control chamber 152 of the second pressure adjusting unit 150.

In contrast, the ink flowing from the first pressure control chamber 122 into the bypass channel 160 flows into the second valve chamber 151 and then passes through the communication port 191B into the second pressure control chamber 152. The ink flowing into the second pressure control chamber 152 through the bypass channel 160 and the ink collected from the collecting channel 140 are sucked into the diaphragm pump 500 through the pump inlet channel 170 by the driving of the diaphragm pump 500. The ink sucked into the diaphragm pump 500 is sent to the pump outlet channel 180 and flows into the first pressure control chamber 122 again. From then, the ink flowing into the second pressure control chamber 152 from the first pressure control chamber 122 through the supply channel 130 and the discharge module 300 and the ink flowing into the second pressure control chamber 152 through the bypass channel 160 flow into the diaphragm pump 500. The ink is sent from the diaphragm pump 500 to the first pressure control chamber 122. Thus, the ink is circulated in the circulation path.

The channel connected to the pressure chamber 12 to supply liquid to the pressure chambers 12 is referred to as "first channel 201", and the other channel connected to the pressure chamber 12 is referred to as "second channel 202". In other words, the pump outlet channel 180 and the supply channel 130 are collectively referred to as "first channel 201", and the collecting channel 140 and the pump inlet channel 170 are collectively referred to as "second channel 202". As shown in FIG. 12, the first channel 201 may include the first pressure adjusting unit 120 for adjusting the pressure of the liquid in the first channel 201, and the pump outlet channel 180 and the supply channel 130 may be connected together via the first pressure adjusting unit 120. Similarly, the second channel 202 may include the second pressure adjusting unit 150 for adjusting the pressure of the liquid in the second channel 202, and the collecting channel 140 and the pump inlet channel 170 may be connected together via the second pressure adjusting unit 150. In other words, the intake hole 501 connects to the second channel 202, and the discharge hole 502 connects to the first channel 201, which enables the diaphragm pump 500 to make the liquid in the second channel 202 flow into the first channel 201.

Thus, this embodiment allows the diaphragm pump 500 to circulate liquid along the circulation path formed in the liquid discharge head 1. This makes it possible to reduce or eliminate ink thickening and deposition of sedimentation components of the color materials of the ink in the discharge module 300, allowing the ink flowability and the discharge characteristics at the discharge port 13 in the discharge module 300 to be kept in good condition.

The circulation path in this embodiment is completed in the liquid discharge head 1. This configuration reduces the circulation path length remarkably as compared with a configuration in which ink is circulated between the liquid discharge head 1 and the ink tank 2 provided outside the liquid discharge head 1. This allows circulation of ink to be performed with a compact diaphragm pump that can be installed in a liquid discharge head.

In a compact diaphragm pump, the joint area of the diaphragm 506 and the supporting member 505 is small, resulting in a decrease in bonding strength. For this reason, the diaphragm pump 500 of this embodiment may be installed in a liquid discharge head.

The liquid discharge head 1 and the ink tank 2 are connected only with an ink supply channel. In other words, a channel for collecting ink from the liquid discharge head 1 into the ink tank 2 is not needed. This requires only an ink supply tube to connect the ink tank 2 and the liquid discharge head 1 eliminates the need for an ink collecting tube. This allows the interior of the liquid discharge apparatus 50 to be simple with reduced number of tubes, thereby reducing the size of the entire apparatus. The reduction of the number of tubes allows reduction of pressure fluctuations of the ink due to vibration of the tubes with the main scanning of the liquid discharge head 1. The vibration of the tubes during the main scanning of the liquid discharge head 1 acts as a drive load on the carriage motor 105 that drives the carriage 60. The reduction of the number of tubes reduces the drive load on the carriage motor 105 and simplifies the main scanning mechanism including the carriage motor 105. This configuration eliminates the need for collecting the ink from the liquid discharge head 1 to the ink tank 2, allowing reduction in the size of the external pump 21. Thus, this embodiment can reduce the size and cost of the liquid discharge apparatus 50.

In the case where the diaphragm bonds to the supporting member in the direction parallel to the direction in which the carriage (mount) moves back and forth (the X-direction), in other words, in the case where the second surface 23 is orthogonal to the direction in which the mount moves back and forth, an inertial force is generated in the direction in which the diaphragm is separated from the supporting member. This may decrease the bonding strength of the diaphragm and the supporting member. For this reason, in the case where the second surface 23 is orthogonal to the direction in which the mount moves back and forth, the diaphragm pump 500 of this embodiment may be installed in the liquid discharge head 1.

Pressure Adjusting Unit

Figure 14A:
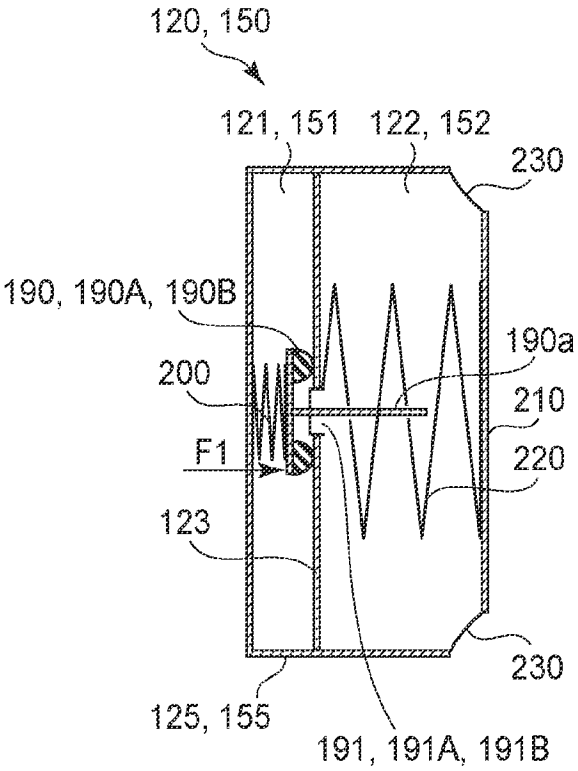
FIG. 14A is a schematic diagram of a pressure adjusting unit in a closed state.
Figure 14B:
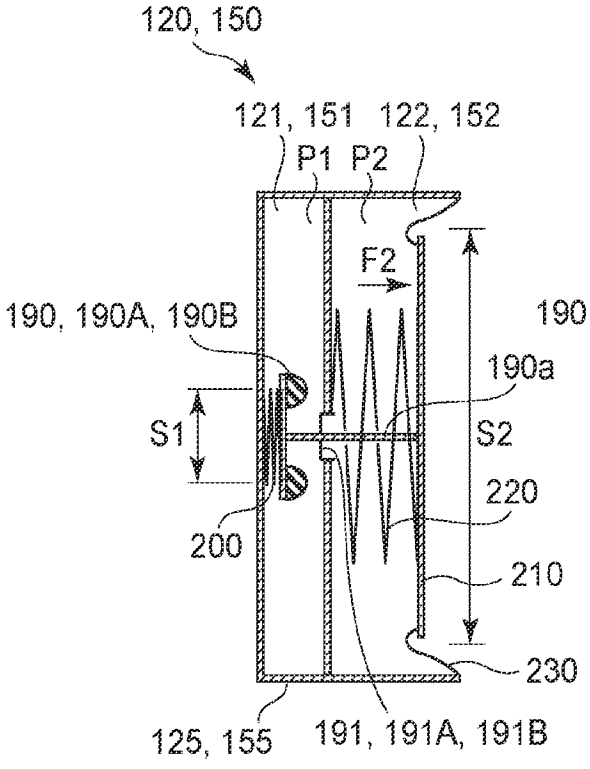
FIG. 14B is a schematic diagram of the pressure adjusting unit in an open state.
Figure 14C:
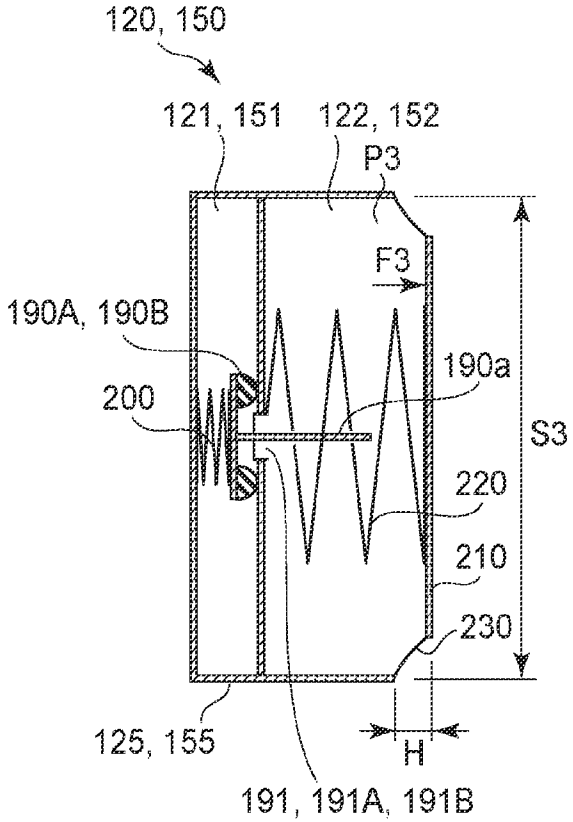
FIG. 14C is a schematic diagram of the pressure adjusting unit in a closed state.

FIGS. 14A to 14C illustrate an example the pressure adjusting unit. Referring to FIGS. 14A to 14C, the configuration and operation of the pressure adjusting units (the first pressure adjusting unit 120 and the second pressure adjusting unit 150) housed in the liquid discharge head 1 will be described in more detail. The first pressure adjusting unit 120 and the second pressure adjusting unit 150 have substantially the same configuration. For this reason, the first pressure adjusting unit 120 will be described as an example, and for the second pressure adjusting unit 150, signs corresponding to the first pressure adjusting unit 120 will be written side by side in FIGS. 14A to 14C. In the case of the second pressure adjusting unit 150, the first valve chamber 121, described below, is read as the second valve chamber 151, the first pressure control chamber 122 is read as the second pressure control chamber 152, and a cylindrical casing 125 is read as a cylindrical casing 155.

The first pressure adjusting unit 120 includes the first valve chamber 121 and the first pressure control chamber 122 formed in the cylindrical casing 125. The first valve chamber 121 and the first pressure control chamber 122 are separated from each other by a partition 123 provided in the cylindrical casing 125. The first valve chamber 121 communicates with the first pressure control chamber 122 via a communication port 191 formed in the partition 123. The first valve chamber 121 includes a valve 190 that switches between the communication and discommunication between the first valve chamber 121 and the first pressure control chamber 122 at the communication port 191. The valve 190 is held at a position facing the communication port 191 by a valve spring 200 and can be brought into close-contact with the partition 123 by the urging force of the valve spring 200. The close-contact of the valve 190 with the partition 123 cuts off the ink flow at the communication port 191. To enhance the closeness to the partition 123, the portion of the valve 190 to come into contact with the partition 123 may be made of an elastic member. The valve 190 has, at the center, a valve shaft 190*a* passing through the communication port 191. Pushing the valve shaft 190*a* against the urging force of the valve spring 200 separates the valve 190 from the partition 123, allowing the ink to flow through the communication port 191. A state in which the ink flow is cut off at the communication port 191 by the valve 190 is referred to as "closed state", and a state in which ink can flow through the communication port 191 is referred to as "open state".

The openings of the cylindrical casing 125 are closed by flexible members 230 and a pressure plate 210. The flexible members 230, the pressure plate 210, the peripheral wall of the casing 125, and the partition 123 form the first pressure control chamber 122. The pressure plate 210 is displaceable with the displacement of the flexible members 230. The pressure plate 210 and the flexible members 230 may be made of any material. For example, the pressure plate 210 may be made of a resin molded member, and the flexible members 230 may be made of resin film. In this case, the pressure plate 210 can be fixed to the flexible members 230 by thermal fusion.

A pressure adjusting spring 220 (an urging member) is provided between the pressure plate 210 and the partition 123. The urging force of the pressure adjusting spring 220 urges the pressure plate 210 and the flexible members 230 in the direction in which the volume of the first pressure control chamber 122 increases, as shown in FIG. 14A. A decrease in the pressure in the first pressure control chamber 122 causes the pressure plate 210 and the flexible members 230 to be displaced in the direction in which the volume of the first pressure control chamber 122 decreases against the pressure of the pressure adjusting spring 220. A decreased in the volume of the first pressure control chamber 122 to a fixed amount causes the pressure plate 210 to come into contact with the valve shaft 190*a* of the valve 190. A further decrease in the volume of the first pressure control chamber 122 causes the valve 190 to move together with the valve shaft 190*a* against the urging force of the valve spring 200 to come away from the partition 123. This brings the communication port 191 to the open state (the state in FIG. 14B).

In this embodiment, the connection in the circulation path is set so that the pressure in the first valve chamber 121 when the communication port 191 is in the open state becomes higher than the pressure in the first pressure control chamber 122.

Accordingly, when the communication port 191 comes to the open state, the ink flows from the first valve chamber 121 into the first pressure control chamber 122. The ink flow causes the flexible members 230 and the pressure plate 210 to be displaced in the direction in which the volume of the first pressure control chamber 122 increases. As a result, the pressure plate 210 is separated from the valve shaft 190*a* of the valve 190, and the valve 190 is brought into close-contact with the partition 123 by the urging force of the valve spring 200, and thus the communication port 191 comes to the closed state (the state in FIG. 14C).

Thus, in the first pressure adjusting unit 120 of this embodiment, when the pressure in the first pressure control chamber 122 decreases to a fixed pressure or less (for example, negative pressure is increased), the ink flows from the first valve chamber 121 into the first pressure control chamber 122 via the communication port 191. For this reason, the first pressure adjusting unit 120 is configured so that the pressure in the first pressure control chamber 122 is not decreased any more. Accordingly, the pressure in the first pressure control chamber 122 is controlled within a fixed range.

Next, the pressure in the first pressure control chamber 122 will be described in more detail.

Assume that the flexible members 230 and the pressure plate 210 are displaced according to the pressure in the first pressure control chamber 122 to bring the pressure plate 210 into contact with the valve shaft 190*a* to bring the communication port 191 into the open state (the state in FIG. 14B), as described above. The relationship between the forces acting on the pressure plate 210 at that time is expressed as Eq. 1.

$$P2\times S2+F2+(P1-P2)\times S1+F1=0 \quad \text{Eq. 1}$$

If Eq. 1 is rearranged for P2, $$P2=-(F1+F2+P1\times S1)/(S2-S1) \quad \text{Eq. 2}$$

P1: Pressure (gauge pressure) in the first valve chamber 121,

P2: Pressure (gauge pressure) in the first pressure control chamber 122, F1: Spring force of the valve spring 200, F2: Spring force of the pressure adjusting spring 220, S1: Pressure receiving area of the valve 190, and S2: Pressure receiving area of the pressure plate 210.

Here, the spring force F1 of the valve spring 200 and the spring force F2 of the pressure adjusting spring 220 are positive in the direction of pushing the valve 190 and the pressure plate 210 (to the right in FIGS. 14A to 14C). The pressure P1 of the first valve chamber 121 and the pressure P2 of the first pressure control chamber 122 are set to satisfy the relation P1>P2.

The pressure P2 in the first pressure control chamber 122 when the communication port 191 comes to the open state is determined by Eq. 2. When the communication port 191 comes to the open state, the ink flows from the first valve chamber 121 into the first pressure control chamber 122 because of the relation of P1>P2. As a result, the pressure P2 in the first pressure control chamber 122 does not decrease any more and is kept at a pressure within a fixed range.

In contrast, the relation between the forces acting on the pressure plate 210 when the pressure plate 210 comes out of contact with the valve shaft 190*a* to bring the communication port 191 to the closed state, as shown in FIG. 14C, is expressed as Eq. 3.

$$P3\times S3+F3=0 \quad \text{Eq. 3}$$

If Eq. 3 is rearranged for P3, $$P3=-F3/S3 \quad \text{Eq. 4}$$

F3: Spring force of the pressure adjusting spring 220 when the pressure plate 210 and the valve shaft 190*a* are out of contact with each other.

P3: Pressure (gauge pressure) of the first pressure control chamber 122 when the pressure plate 210 and the valve shaft 190*a* are out of contact with each other.

S3: Pressure receiving area of the pressure plate 210 when the pressure plate 210 and the valve shaft 190*a* are out of contact with each other. FIG. 14C shows a state in which the pressure plate 210 and the flexible members 230 are displaced to the right in the drawing to a displaceable limit. The pressure P3 in the first pressure control chamber 122, the spring force F3 of the pressure adjusting spring 220, and the pressure receiving area S3 of the pressure plate 210 change according to the amount of displacement of the pressure plate 210 and the flexible members 230 to the state shown in FIG. 14C. Specifically, when the pressure plate 210 and the flexible members 230 are closer to the left in FIG. 14C than in FIG. 14B, the pressure receiving area S3 of the pressure plate 210 increases, and the spring force F3 of the pressure adjusting spring 220 increases.

As a result, the pressure P3 in the first pressure control chamber 122 decreases because of the relation of Eq. 4. Accordingly, the pressure in the first pressure control chamber 122 increases gradually during the period from the state in FIG. 14B to the state in FIG. 14C because of the relations of Eq. 2 and Eq. 4 (that is, the negative pressure decreases to a positive pressure). In other words, the pressure plate 210 and the flexible members 230 are gradually displaced to the right from the state in which the communication port 191 is in the open state, and the pressure in the first pressure control chamber increases gradually until the volume of the first pressure control chamber 122 reaches a displaceable limit finally. That is, the negative pressure decreases.

Ink Flow in Liquid Discharge Head

Figure 15A:
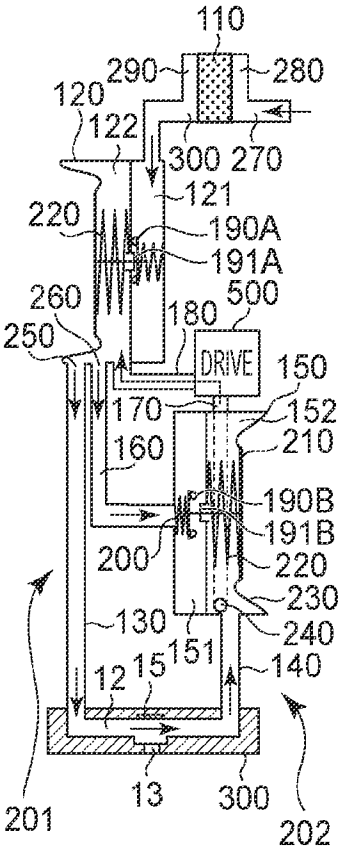
FIG. 15A is a schematic diagram illustrating an ink flow in a recording operation.

FIGS. 15A to 15E are diagrams illustrating the ink flow in the liquid discharge head 1. Referring to FIGS. 15A to 15E, the circulation of ink in the liquid discharge head 1 will be described. FIG. 15A schematically shows the ink flow in a recording operation for discharging ink from the discharge port 13 for recording. The arrows in the drawings indicate the flow of ink. In this embodiment, both the external pump 21 and the diaphragm pump 500 start driving in a recording operation. The external pump 21 and the diaphragm pump 500 may be driven regardless of the recoding operation. The driving of the external pump 21 and the diaphragm pump 500 do not have to be operably connected. They may be driven independently.

During the recording operation, the diaphragm pump 500 is in ON state (driven state) in which the ink flowing out of the first pressure control chamber 122 flows into the supply channel 130 and the bypass channel 160. The ink flowing into the supply channel 130 passes through the discharge module 300 into the collecting channel 140 and is then supplied to the second pressure control chamber 152.

In contrast, the ink flowing from the first pressure control chamber 122 into the bypass channel 160 passes through the second valve chamber 151 into the second pressure control chamber 152. The ink flowing into the second pressure control chamber 152 passes through the pump inlet channel 170, the diaphragm pump 500, and the pump outlet channel 180 and flows into the first pressure control chamber 122 again. At that time, the control pressure of the first valve chamber 121 is set higher than the control pressure of the first pressure control chamber 122 on the basis of the relation of Eq. 2 described above. Accordingly, the ink in the first pressure control chamber 122 is supplied to the discharge module 300 again through the supply channel 130 without flowing into the first valve chamber 121. The ink flowing into the discharge module 300 passes through the collecting channel 140, the second pressure control chamber 152, the pump inlet channel 170, the diaphragm pump 500, and the pump outlet channel 180 and flows into the first pressure control chamber 122 again. Thus, ink circulation completed in the liquid discharge head 1 is performed.

In the above ink circulation, the amount (flow rate) of ink circulated in in the discharge module 300 is determined by the difference in control pressure between the first pressure control chamber 122 and the second pressure control chamber 152. The pressure difference is set to provide such a circulation amount that the ink thickening in the vicinity of the discharge port 13 in the discharge module 300 can be prevented. The ink corresponding to the amount of ink consumed by recording is supplied from the ink tank 2 to the first pressure control chamber 122 through the filter 110 and the first valve chamber 121. How the consumed ink is made up will be described in detail. Since the ink decreases from the interior of the circulation path by an amount corresponding to the ink consumed by recording, the pressure in the first pressure control chamber 122 decreases, and as a consequence, the ink in the first pressure control chamber 122 also decreases. As the ink in the first pressure control chamber 122 decreases, the volume of the first pressure control chamber 122 decreases. The decrease in the volume of the first pressure control chamber 122 causes the communication port 191A to come to the open state, and the ink is supplied from the first valve chamber 121 to the first pressure control chamber 122. This supplied ink loses in pressure while passing moving from the first valve chamber 121 through the communication port 191A into the first pressure control chamber 122. This causes the ink in the positive pressure to switch to a negative pressure. The inflow of the ink from the first valve chamber 121 to the first pressure control chamber 122 increases the pressure in the first pressure control chamber 122 to increases the volume in the first pressure control chamber 122, causing the communication port 191A to come to the closed state. Thus, the communication port 191A repeats the open state and the closed state according to the consumption of the ink. If no ink is consumed, the communication port 191A is kept in the closed state.

Figure 15B:
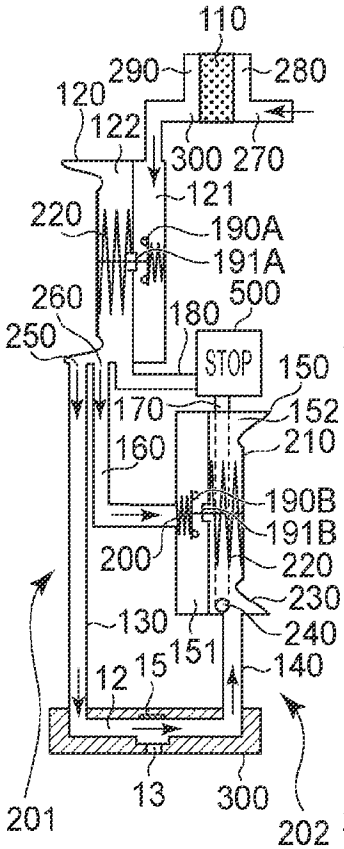
FIG. 15B is a schematic diagram illustrating an ink flow immediately after the recording operation ends.

FIG. 15B schematically shows an ink flow immediately after the recording operation ends, and the diaphragm pump 500 comes to OFF state (stopped state). At the end of the recording operation, when the diaphragm pump 500 is turned off, both the pressure in the first pressure control chamber 122 and the pressure in the second pressure control chamber 152 are in the controlled pressure during the recording operation. This causes the ink to move as in FIG. 15B according to the difference in pressure between the first pressure control chamber 122 and the second pressure control chamber 152. Specifically, an ink flow from the first pressure control chamber 122 to the discharge module 300 through the supply channel 130 and thereafter passing through the collecting channel 140 to the second pressure control chamber 152 is continuously generated. An ink flow from the first pressure control chamber 122 to the second pressure control chamber 152 through the bypass channel 160 and the second valve chamber 151 is also continued.

The amount of ink corresponding to the amount of ink moved from the first pressure control chamber 122 to the second pressure control chamber 152 by the ink flows is supplied from the ink tank 2 to the first pressure control chamber 122 through the filter 110 and the first valve chamber 121. This allows the content in the first pressure control chamber 122 to be kept constant. When the content in the first pressure control chamber 122 is constant, the spring force F1 of the valve spring 200, the spring force F2 of the pressure adjusting spring 220, the pressure receiving area S1 of the valve 190, and the pressure receiving area S2 of the pressure plate 210 are kept constant from the relation in Eq. 2 described above. For this reason, the pressure in the first pressure control chamber 122 is determined according to a change in the pressure (gauge pressure) P1 in the first valve chamber 121. Accordingly, if the pressure P1 in the first valve chamber 121 does not change, the pressure P2 in the first pressure control chamber 122 is kept at the same pressure as the control pressure in the recording operation.

Figure 15C:
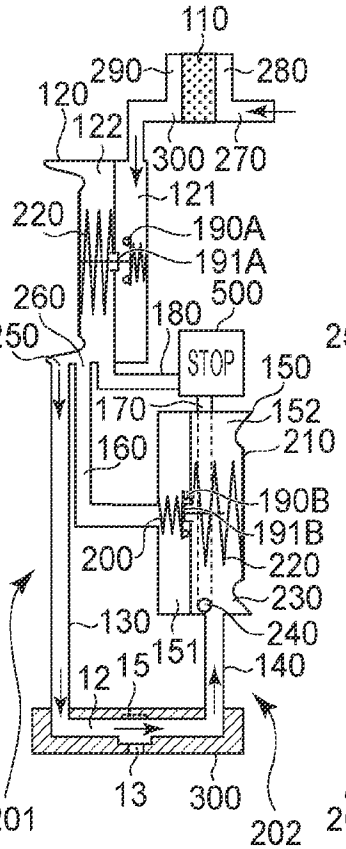
FIG. 15C is a schematic diagram illustrating an ink flow after the closed state to a noncommunicating state.
Figure 15D:
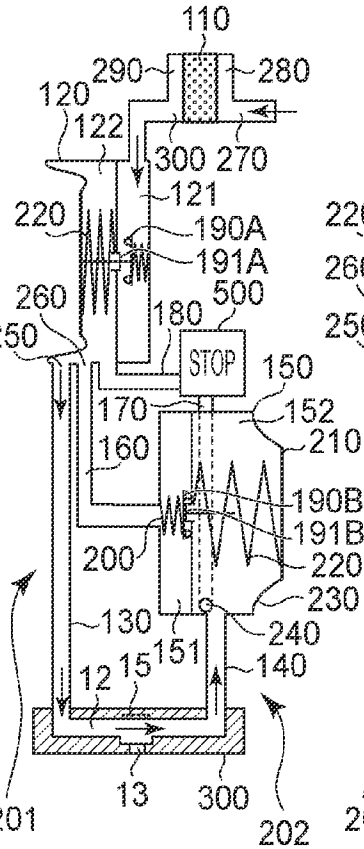
FIG. 15D is a schematic diagram illustrating an ink flow from a collecting channel to a pressure control chamber.

The pressure in the second pressure control chamber 152 changes with time according to a change in content caused by the ink flow from the first pressure control chamber 122. Specifically, the pressure in the second pressure control chamber 152 changes from the state in FIG. 15B according to Eq. 2 during the period until the communication port 191 comes to the closed state so that the second valve chamber 151 and the second pressure control chamber 152 come to a noncommunicating state, as shown in FIG. 15C. Thereafter, the pressure plate 210 and the valve shaft 190*a* come to a non-contact state to bring the communication port 191 to the closed state. Then, the ink flows from the collecting channel 140 into the second pressure control chamber 152, as shown in FIG. 15D. The ink flow causes the pressure plate 210 and the flexible members 230 to be displaced, and the pressure in the second pressure control chamber 152 changes, that is, increases, until the volume of the second pressure control chamber 152 becomes maximum according to Eq. 4.

In the state in FIG. 15C, the ink flow from the first pressure control chamber 122 through the bypass channel 160 and the second valve chamber 151 to the second pressure control chamber 152 does not occur. Accordingly, only a flow of ink from the first pressure control chamber 122 through the supply channel 130, the discharge module 300, and the collecting channel 140 into the second pressure control chamber 152 is generated.

The movement of the ink from the first pressure control chamber 122 to the second pressure control chamber 152 occurs according to the pressure difference between the first pressure control chamber 122 and the second pressure control chamber 152, as described above.

Therefore, when the pressure in the second pressure control chamber 152 becomes equal to the pressure in the first pressure control chamber 122, the movement of the ink stops.

Figure 15E:
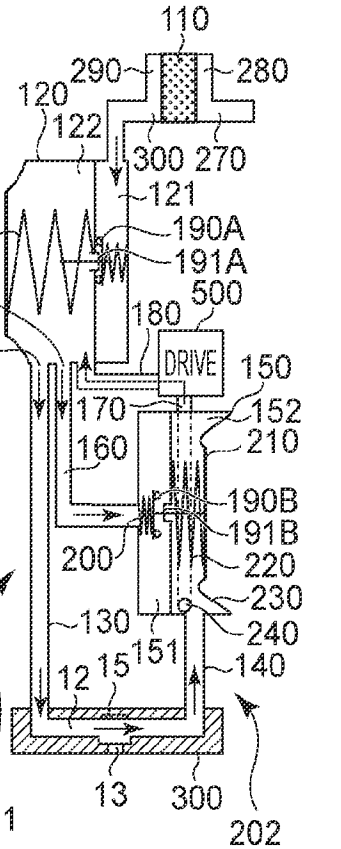
FIG. 15E is a schematic diagram illustrating an ink flow from the state in FIG. 15D until the diaphragm pump is driven.

In the state in which the pressure in the second pressure control chamber 152 is equal to the pressure in the first pressure control chamber 122, the second pressure control chamber 152 expands to the state shown in FIG. 15D. The expansion of the second pressure control chamber 152 as shown in FIG. 15D forms an ink reservoir in the second pressure control chamber 152. The time from the stop of the diaphragm pump 500 to the state in FIG. 15D, which depends on the shape and size of the channels and properties of the ink, is about 1 to 2 minutes. When the diaphragm pump 500 is driven from the state in FIG. 15D in which the ink is stored in the reservoir, the ink in the reservoir is supplied to the first pressure control chamber 122 by the diaphragm pump 500. This causes the amount of the ink in the first pressure control chamber 122 to be increased and the flexible members 230 and the pressure plate 210 to be displaced in the expanding direction, as shown in FIG. 15E. When the driving of the diaphragm pump 500 is continued, the state in the circulation path changes, as shown in FIG. 15A.

Although FIG. 15A is an example during a recording operation, the ink may be circulated without the recording operation. In this case also, the ink flow as shown in FIGS. 15A to 15E occurs in response to the drive and stop of the diaphragm pump 500.

In this embodiment, the communication port 191B of the second pressure adjusting unit 150 comes into the open state when the diaphragm pump 500 is driven to circulate the ink, and comes into the closed state when the ink circulation is stopped, as described above. This is given for mere illustrative purposes. The control pressure may be set so that, even when the diaphragm pump 500 is driven to circulate the ink, the communication port 191B of the second pressure adjusting unit 150 is in the closed state. This will be described specifically together with the role of the bypass channel 160.

The bypass channel 160 connecting the first pressure adjusting unit 120 and the second pressure adjusting unit 150 together is provided to prevent a negative pressure generated in the circulation path, if higher than a predetermined value, from affecting the discharge module 300. The bypass channel 160 is provided also to supply the ink to the pressure chambers 12 from both the supply channel 130 and the collecting channel 140. In other words, the bypass channel 160 makes the first channel 201 and the second channel 202 communicate not via the pressure chamber 12.

First, an example in which the bypass channel 160 is provided to prevent a negative pressure higher than a predetermined value from affecting the discharge module 300 will be described. For example, the properties (for example, viscosity) of the ink can be changed by a change in ambient temperature. The change in the viscosity of the ink causes a change in the pressure loss in the circulation path. For example, a decrease in the viscosity of the ink decreases the pressure loss in the circulation path. This increases the flow rate of the diaphragm pump 500 driven at a constant driving amount, thereby increasing the flow rate of the discharge module 300. In contrast, the discharge module 300 is kept at a fixed temperature by a temperature adjusting mechanism (not shown), so that the viscosity of the ink in the discharge module 300 is kept constant even if the ambient temperature changes. Since the viscosity of the ink in the discharge module 300 does not change, and the flow rate of the ink flowing in the discharge module 300 increases, the negative pressure in the discharge module 300 is increased because of the flow resistance. The negative pressure in the discharge module 300 higher than the predetermined value may break the meniscus at the discharge port 13 to attract the external air into the circulation path, hindering normal discharge. Even if the meniscus is not broken, the negative pressure in the pressure chambers 12 becomes higher than the predetermined pressure, which may affect the discharge.

For this reason, this embodiment includes the bypass channel 160 in the circulation path. The bypass channel 160 allows the ink to flow therethrough when the negative pressure is higher than a predetermined value, allowing the pressure in the discharge module 300 to be kept constant. Accordingly, the control pressure of the second pressure adjusting unit 150 may be set so that the communication port 191B can be kept in the closed state even if the diaphragm pump 500 is in operation. The control pressure of the second pressure adjusting unit 150 may be set so that the communication port 191B of the second pressure adjusting unit 150 comes to the open state when the negative pressure becomes higher than the predetermined value. In other words, provided that the meniscus is not broken, or a predetermined negative pressure is maintained even if the flow rate of the diaphragm pump 500 is changed because of a change in viscosity due to an environmental change, the communication port 191B may be in the closed state when the diaphragm pump 500 is in operation.

Next, an example in which the bypass channel 160 is provided to supply ink to the pressure chamber 12 from both the supply channel 130 and the collecting channel 140 will be described. A pressure change in the circulation path can be generated also by a discharge operation using the discharge element 15. This is because the discharge operation causes a force to attract the ink to the pressure chamber 12. The duty, which depends of various conditions, is set at 100% in a state in which a 4-pl ink drop is recorded on a grid of 1,200 dpi. High-duty recording is recording at, for example, a duty of 100%.

The point that, for high-duty recording, ink is supplied to the pressure chamber 12 from both the supply channel 130 and the collecting channel 140 will be described.

Continuous high-duty recording decreases the amount of ink flowing from the pressure chambers 12 into the second pressure control chamber 152 through the collecting channel 140 decreases. Meanwhile, the diaphragm pump 500 lets the ink flow at a constant amount. This unbalances the inflow and outflow in the second pressure control chamber 152 to decrease the ink in the second pressure control chamber 152, increasing the negative pressure in second pressure control chamber 152, thereby contracting the second pressure control chamber 152. The increase in the negative pressure in the second pressure control chamber 152 increases the amount of ink flowing into the second pressure control chamber 152 through the bypass channel 160, balancing the outflow and inflow of the second pressure control chamber 152. Thus, the negative pressure in the second pressure control chamber 152 increases in response to the duty. In the configuration in which the communication port 191B is in the closed state when the diaphragm pump 500 is in operation, the communication port 191B goes to the open state according to the duty, so that the ink flows from the bypass channel 160 into the second pressure control chamber 152.

Further continuation of high-duty recording decreases the amount of ink flowing from the pressure chamber 12 into the second pressure control chamber 152 through the collecting channel 140, and instead, increases the amount of ink flowing into the second pressure control chamber 152 through the bypass channel 160 via the communication port 191B. Still further continuation of this state reduces the amount of ink flowing from the pressure chamber 12 into the second pressure control chamber 152 through the collecting channel 140 into zero, and the whole of the ink flowing to the diaphragm pump 500 comes from the communication port 191B. Still further continuation causes the ink to flow back from the second pressure control chamber 152 into the pressure chamber 12 through the collecting channel 140. In this state, the ink flowing out of the second pressure control chamber 152 into the diaphragm pump 500 and the ink flowing into the pressure chamber 12 flows into the second pressure control chamber 152 via the communication port 191B through the bypass channel 160. In this case, the pressure chamber 12 is filled with the ink from the supply channel 130 and the ink from the collecting channel 140 and is then discharged.

The backflow of the ink that occurs at high recording duty is a phenomenon caused by the presence of the bypass channel 160. The above is an example in which the communication port 191B in the second pressure adjusting unit comes to the open state with the backflow of the ink. The backflow of the ink can occur in a state in which the communication port 191B in the second pressure adjusting unit is in the open state. Even in a configuration without the second pressure adjusting unit, the presence of the bypass channel 160 can cause the backflow of ink.

Configuration of Discharge Unit

Figure 16A:
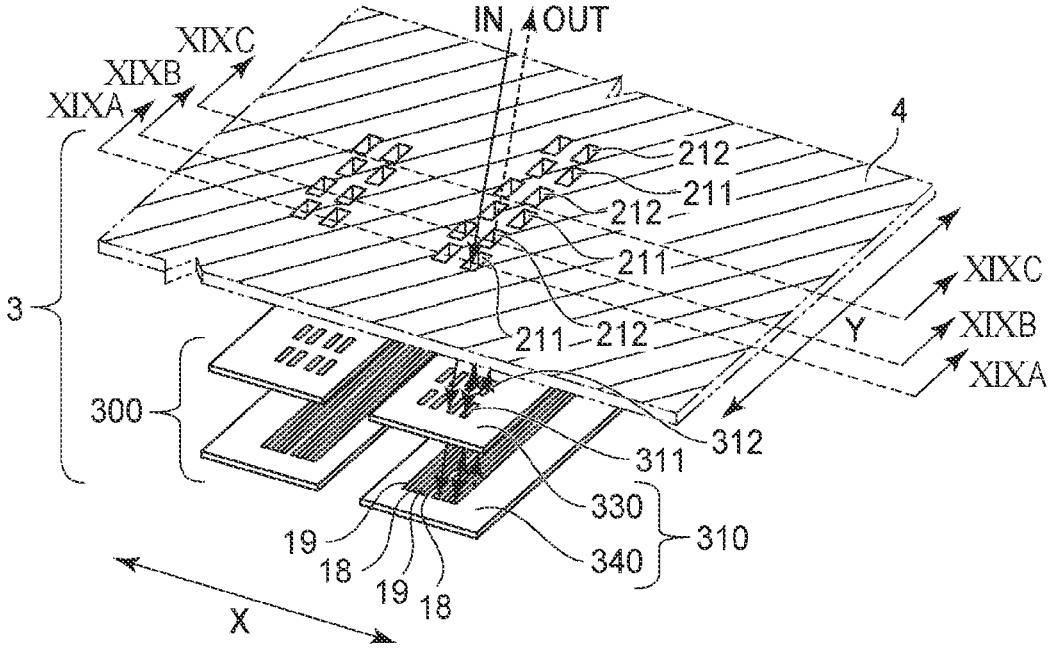
FIG. 16A is an exploded perspective view of a discharge unit seen from a first supporting member.
Figure 16B:
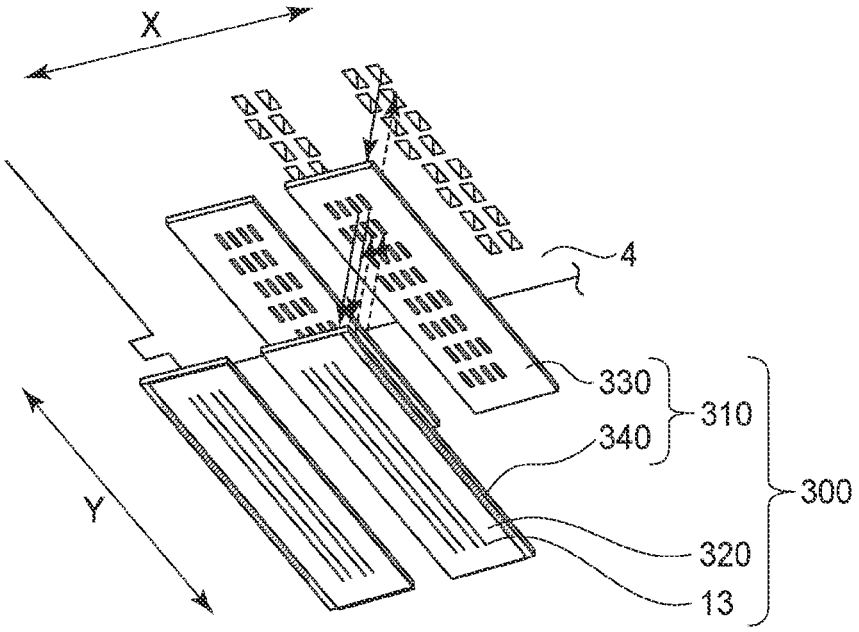
FIG. 16B is an exploded perspective view of the discharge unit seen from a discharge module.
Figure 17:
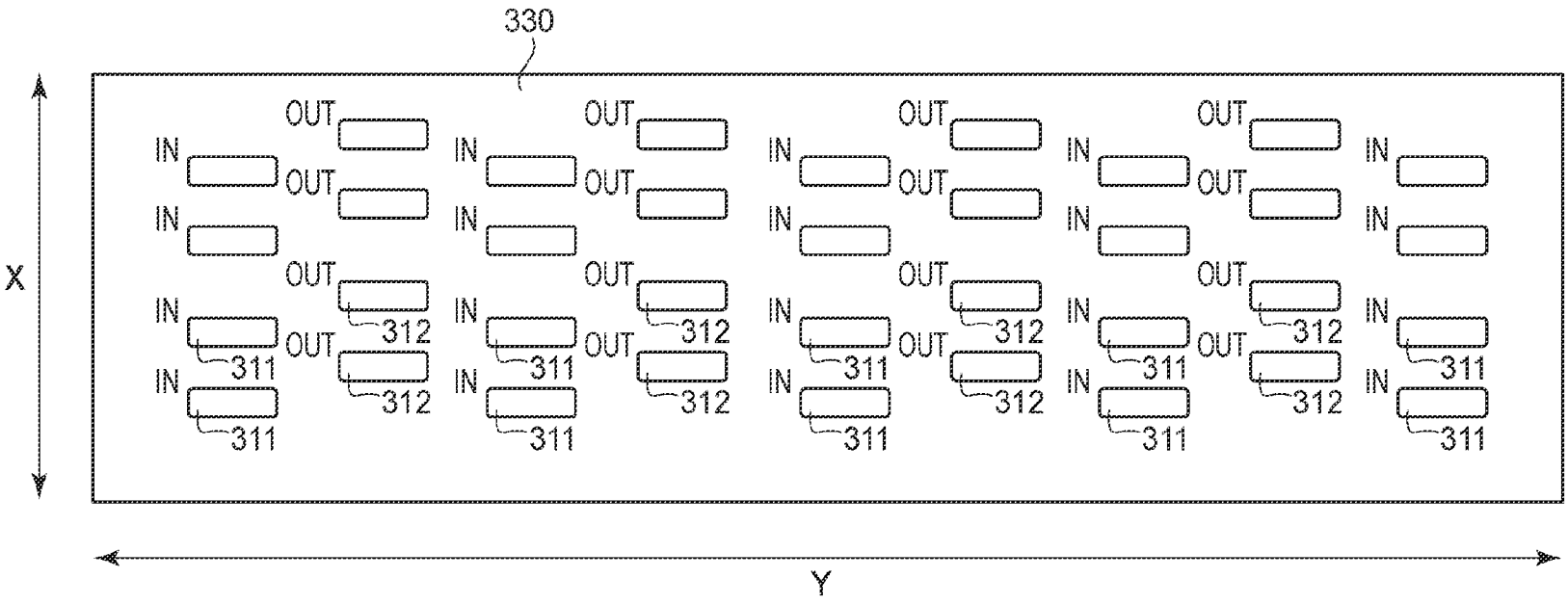
FIG. 17 is a diagram illustrating an opening plate.
Figure 23A:
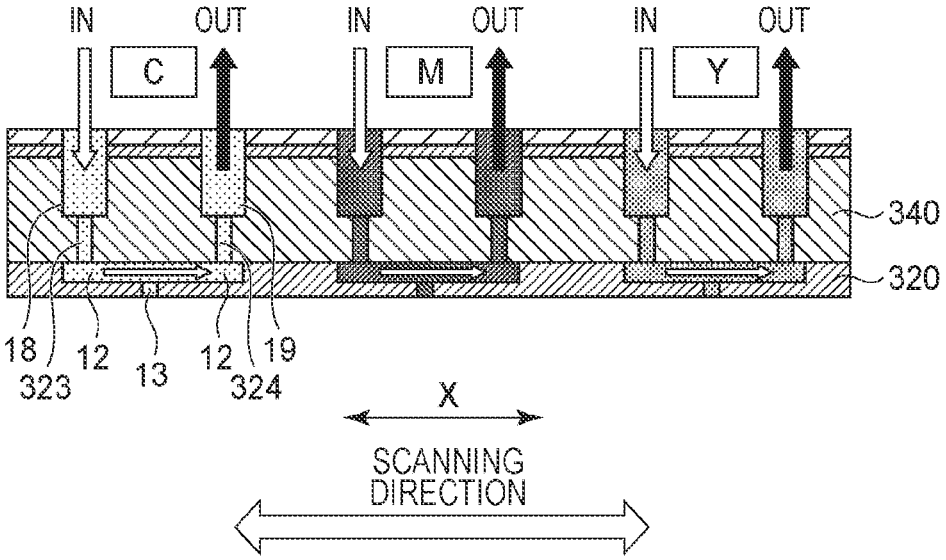
FIGS. 23A and 23B are schematic diagrams of the channel configuration of a liquid discharge head for color inks.
Figure 23B:
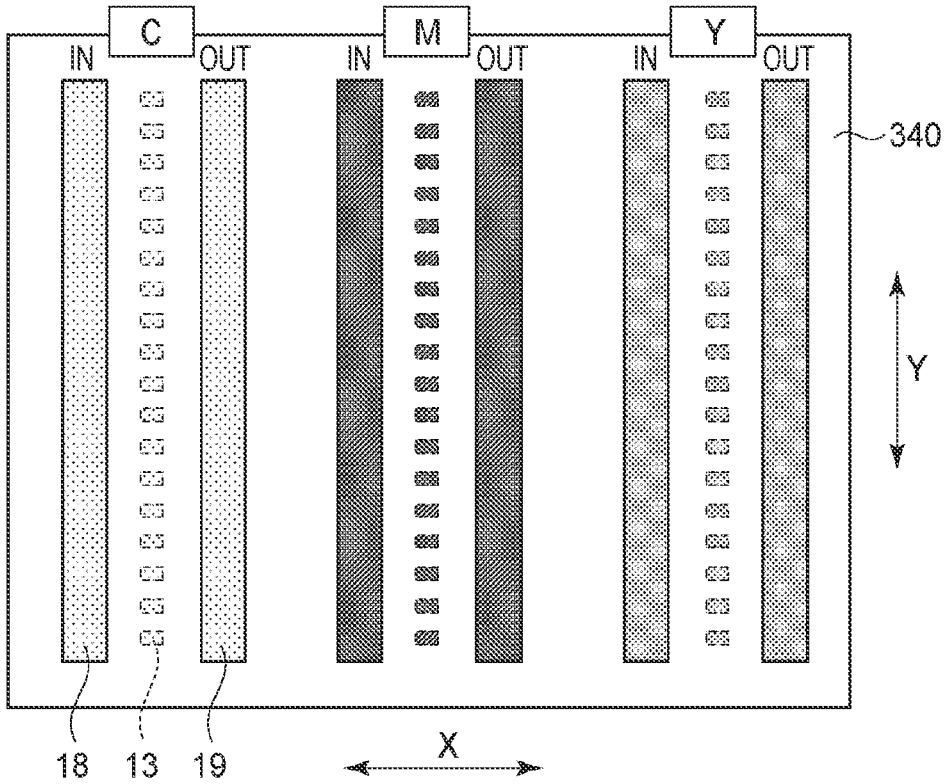
Figure 24A:
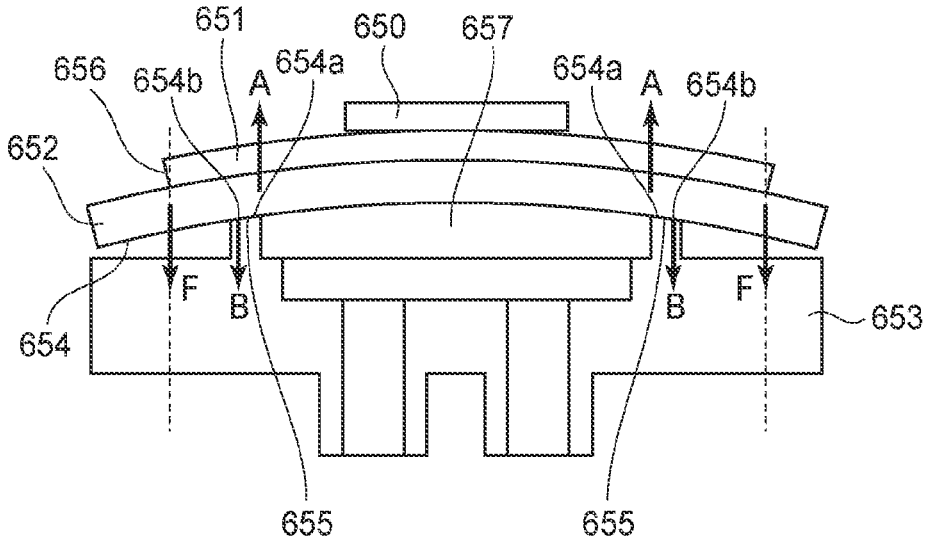
FIG. 24A is a schematic diagram of a diaphragm pump in a related art example, illustrating a state in which the diaphragm vibrates in a direction in which the pump chamber expands.
Figure 24B:
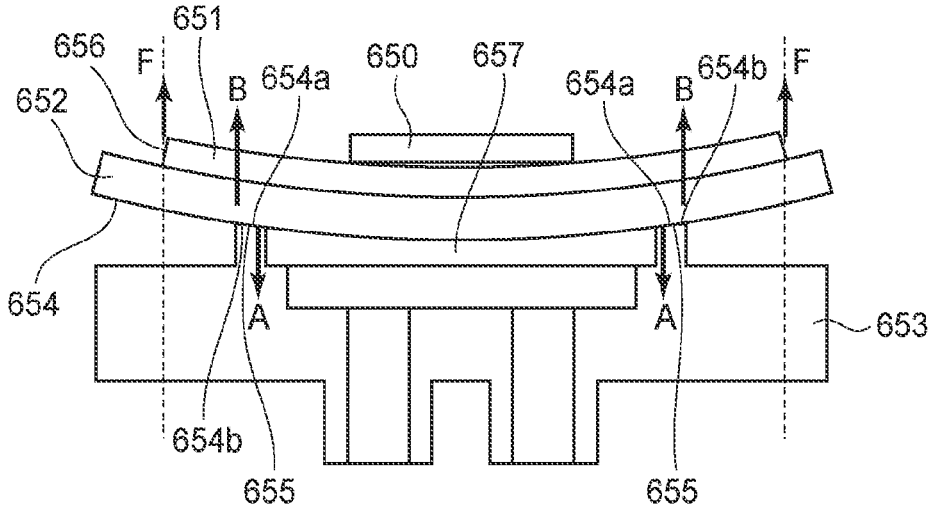
FIG. 24B is a schematic diagram of the diaphragm pump in a related art example, illustrating a state in which the diaphragm vibrates in a direction in which the pump chamber contracts.

FIGS. 16A and 16B are schematic diagrams of the circulation path for one color ink in the discharge unit 3 of this embodiment. FIG. 16A is an exploded perspective view of the discharge unit 3 seen from the first supporting member 4. FIG. 16B is an exploded perspective view of the discharge unit 3 seen from the discharge module 300. The arrows denoted as IN and OUT in FIG. 16A indicate ink flows. Although the ink flows are illustrated only for one color, this also applies to the other colors. The second supporting member 7 and the electrical wiring member 5 are omitted in FIGS. 16A and 16B, as well as in the following description of the discharge unit 3. The first supporting member 4 in FIG. 16A is shown in cross section taken along line XVIA-XVIA in FIG. 10A. The discharge module 300 includes a discharge element substrate 340 and an opening plate 330. FIG. 17 is a diagram illustrating the opening plate 330. FIGS. 23A and 23B are diagrams illustrating the discharge element substrate 340.

The discharge unit 3 is supplied with ink from the circulation unit 54 via the joint member 8 (see FIG. 10A). An ink path after the ink passes through the joint member 8 until the ink returns to the joint member 8 will be described. In the following drawings, the joint member 8 is omitted.

The discharge module 300 includes the discharge element substrate 340 and the opening plate 330 constituting the silicon substrate 310 and further includes the discharge-port formed member 320. The discharge element substrate 340, the opening plate 330, and the discharge-port formed member 320 are bonded together so that the ink channels communicate to form the discharge module 300, and the discharge module 300 is supported by the first supporting member 4. The discharge module 300 is supported by the first supporting member 4 to form the discharge unit 3. The discharge element substrate 340 includes the discharge-port formed member 320 including a plurality of discharge port arrays in which the plurality of discharge ports 13 is arrayed and discharges part of the ink supplied through the ink channel in the discharge module 300 from the discharge ports 13. Ink that was not discharged is collected through the ink channel in the discharge module 300.

As shown in FIGS. 16A and 17, the opening plate 330 includes a plurality of arrayed ink supply ports 311 and a plurality of arrayed ink collecting ports 312. As shown in FIG. 18 and FIGS. 19A to 19C, the discharge element substrate 340 includes a plurality of arrayed supply connecting channels 323 and a plurality of arrayed collection connecting channels 324. The discharge element substrate 340 further includes the common supply channels 18 each communicating with the plurality of supply connecting channels 323 and the common collecting channels 19 each communicating with the plurality of collection connecting channels 324. The ink channels in the discharge unit 3 are formed by connecting the ink supply channels 48 and the ink collecting channels 49 (see FIG. 10A) in the first supporting member 4 with the channels in the discharge module 300. Supporting member supply ports 211 are cross-sectional openings forming the ink supply channels 48 and supporting member collection ports 212 are cross-sectional openings forming the ink collecting channels 49.

The ink to be supplied to the discharge unit 3 is supplied through the circulation unit 54 (FIG. 10A) to the ink supply channel 48 (FIG. 10A) in the first supporting member 4. The ink flowing through the supporting member supply port 211 in the ink supply channel 48 is supplied to the common supply channel 18 in the discharge element substrate 340 through the ink supply channel 48 (FIG. 10A) and the ink supply port 311 of the opening plate 330 into the supply connecting channel 323. This is a supply channel. Thereafter, the ink passes through the pressure chamber 12 (see FIG. 10B) of the discharge-port formed member 320 into the collection connecting channel 324 of the collection channel. The details of the ink flow in the pressure chamber 12 will be described below.

In the collecting channel, the ink that has entered the collection connecting channel 324 flows to the common collecting channel 19. Thereafter, the ink flows from the common collecting channel 19 to the ink collecting channel 49 in the first supporting member 4 via the ink collecting port 312 of the opening plate 330 and is collected to the circulation unit 54 through the supporting member collection port 212.

Areas of the opening plate 330 having no ink supply ports 311 and no ink collecting ports 312 correspond to areas of the first supporting member 4 separating the supporting member supply ports 211 and the supporting member collection ports 212. The areas of the first supporting member 4 have no opening. These areas are used as bonding areas in bonding the discharge module 300 and the first supporting member 4 together.

Figure 18:
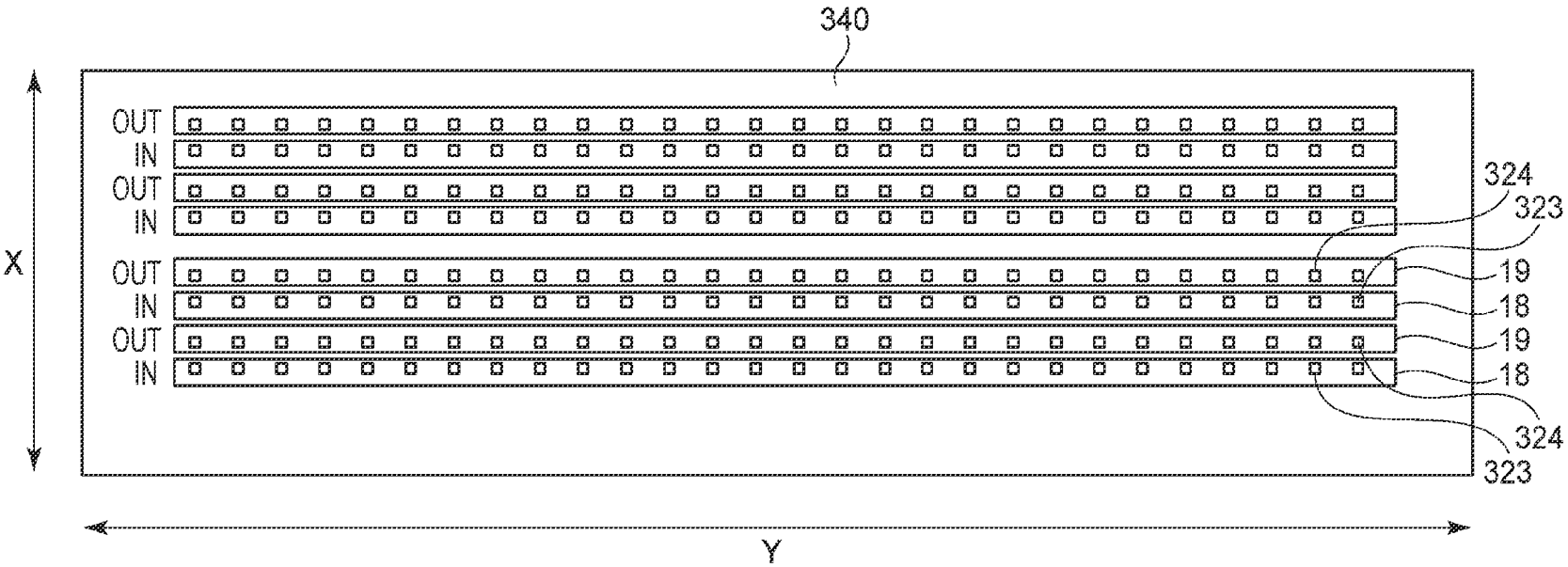
FIG. 18 is a diagram illustrating a discharge element substrate.

In FIG. 17, the opening plate 330 includes a plurality of arrays of openings, which are arrayed in the X-direction, in the Y-direction, in which supply (IN) openings and collecting (OUT) openings are alternately arrayed in the Y-direction so as to be half a pitch out of alignment in the X-direction. In FIG. 18, the discharge element substrate 340 includes the common supply channels 18 each communicating with the plurality of supply connecting channels 323 arrayed in the Y-direction and the common collecting channels 19 each communicating with the plurality of collection connecting channels 324 arrayed in the Y-direction. The common supply channels 18 and the common collecting channels 19 are alternately arrayed in the X-direction. The common supply channels 18 and the common collecting channels 19 are separated for each type of ink, and the number of the common supply channels 18 and the number of the common collecting channels 19 are determined according to the number of discharge port arrays for each color. The supply connecting channels 323 and the collection connecting channels 324 are also disposed in number corresponding to the discharge ports 13. The supply connecting channels 323 and the collection connecting channels 324 do not necessarily have to be in one-to-one correspondence with the discharge ports 13. One supply connecting channel 323 and one collection connecting channel 324 may be provided for a plurality of discharge ports 13.

The opening plate 330 and the discharge element substrate 340 are overlapped and bonded together so that the ink channels communicate to constitute the discharge module 300 and are supported by the first supporting member 4, thereby forming the ink channel including the supply channel and the collecting channel described above.

Figure 19A:
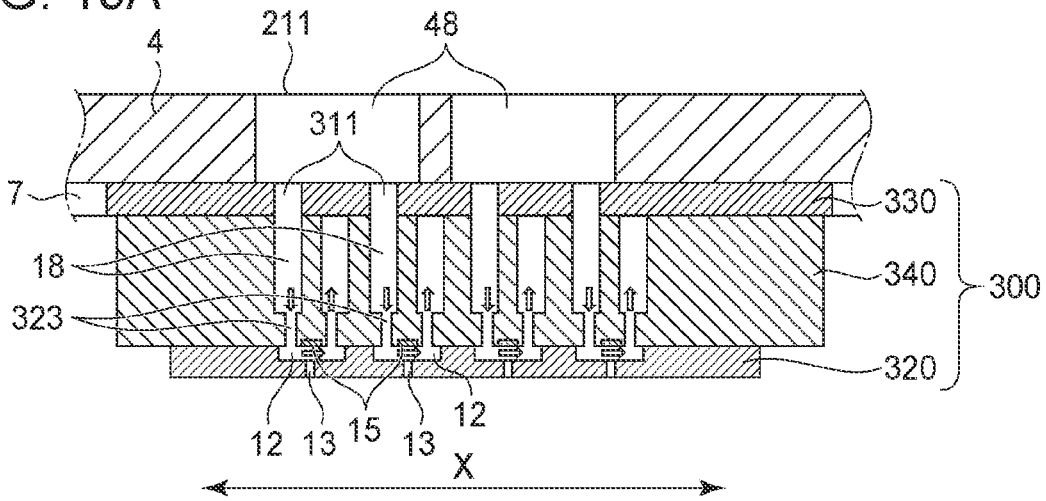
FIG. 19A is a cross-sectional view of FIG. 16A taken along line XIXA-XIXA.
Figure 19B:
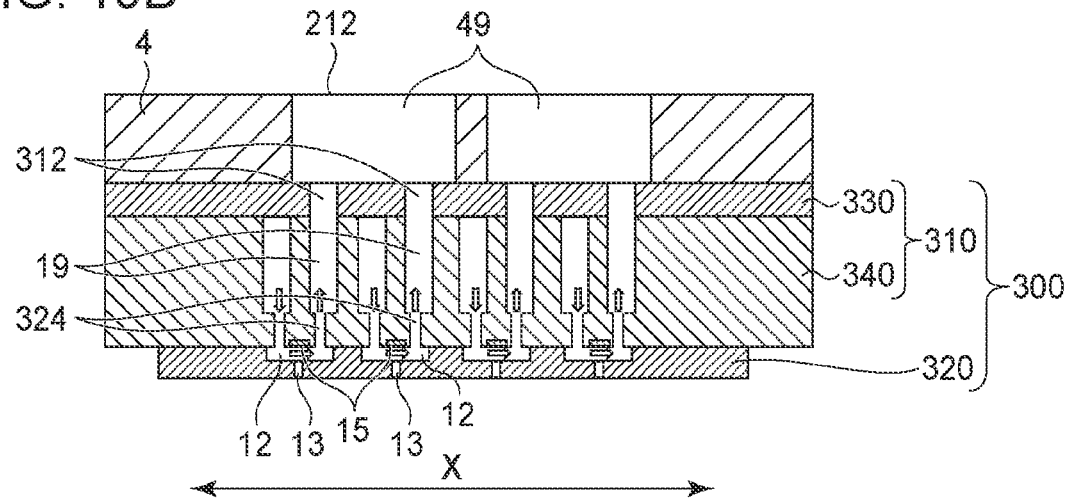
FIG. 19B is a cross-sectional view of FIG. 16A taken along line XIXB-XIXB.
Figure 19C:
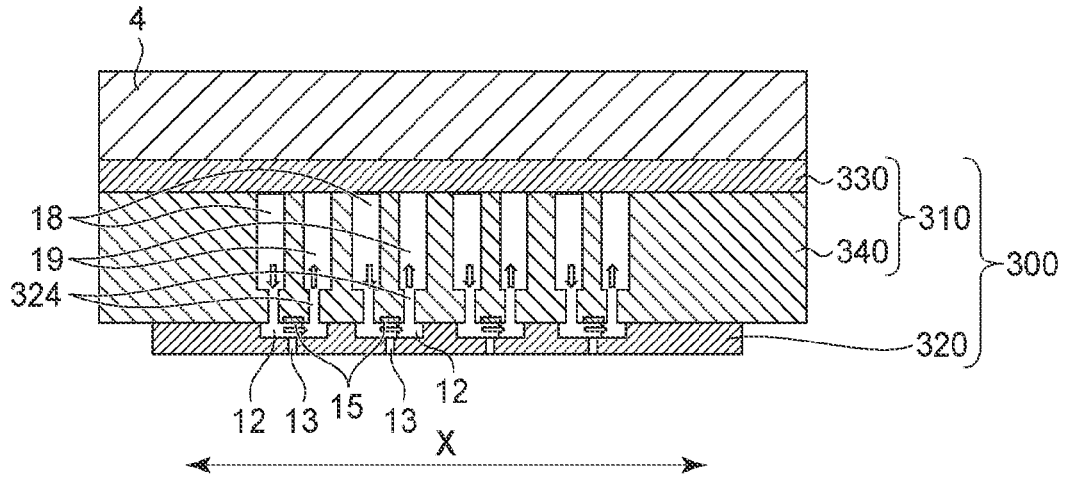
FIG. 19C is a cross-sectional view of FIG. 16A taken along line XIXC-XIXC.

FIGS. 19A to 19C are cross-sectional views of the discharge unit 3 illustrating ink flows in different portions. FIG. 19A is a cross-sectional view of FIG. 16A taken along line XIXA-XIXA illustrating a cross section of a portion of the discharge unit 3 where the ink supply channels 48 and the ink supply ports 311 communicate with each other. FIG. 19B is a cross-sectional view of FIG. 16A taken along line XIXB-XIXB illustrating a cross section of a portion of the discharge unit 3 where the ink collecting channels 49 and the ink collecting ports 312 communicate with each other. FIG. 19C is a cross-sectional view of FIG. 16A taken along line XIXC-XIXC illustrating a cross section of a portion of the discharge unit 3 where the ink supply ports 311 and the ink collecting ports 312 do not communicate with the channels in the first supporting member 4.

In the supply channels for supplying ink, the ink is supplied from the portions where the ink supply channels 48 of the first supporting member 4 and the ink supply ports 311 of the opening plate 330 overlap and communicate with each other, as shown FIG. 19A. In the collecting channels for collecting ink, the ink is collected from the portions where the ink collecting channels 49 of the first supporting member 4 and the ink collecting ports 312 of the opening plate 330 overlap and communicate with each other, as shown in FIG. 19B. The discharge unit 3 also has an area where no opening is provided in the opening plate 330, as shown in FIG. 19C. In this area, no ink is supplied and collected between the discharge element substrate 340 and the first supporting member 4. Ink is supplied in the area where the ink supply ports 311 are provided as in FIG. 19A, and ink is collected in the area where the ink collecting ports 312 are provided as in FIG. 19B. This embodiment has been described using an example in which the opening plate 330 is used. However, the opening plate 330 may be omitted. For example, the first supporting member 4 may include channels corresponding to the ink supply channels 48 and the ink collecting channels 49, and the discharge element substrate 340 may be bonded to the first supporting member 4.

Figure 20A:
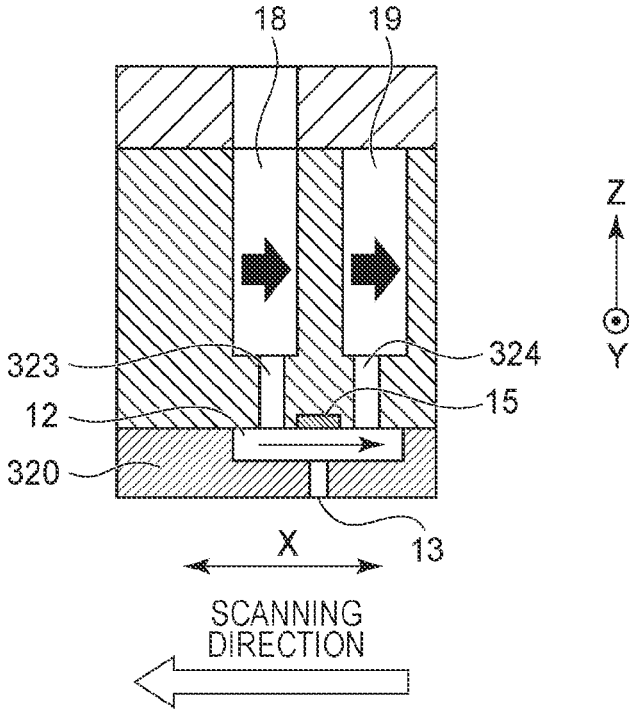
FIGS. 20A and 20B are cross-sectional views of the vicinity of a discharge port.
Figure 20B:
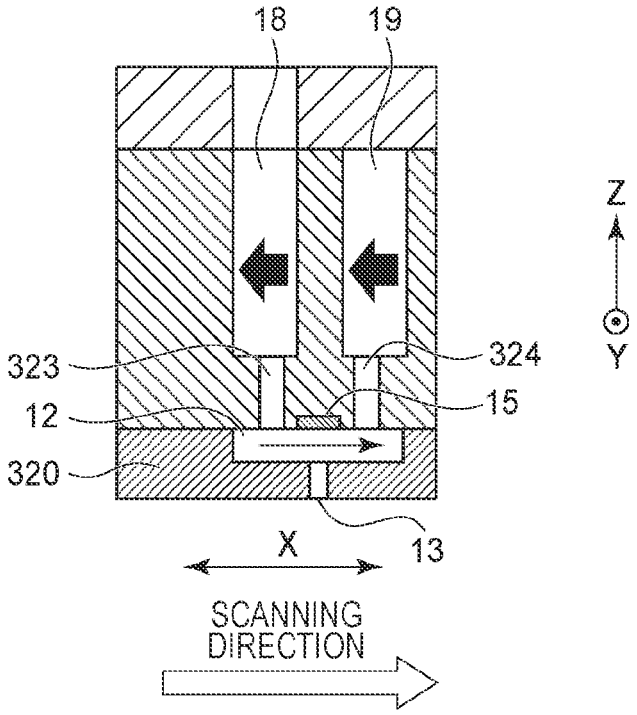
Figure 21A:
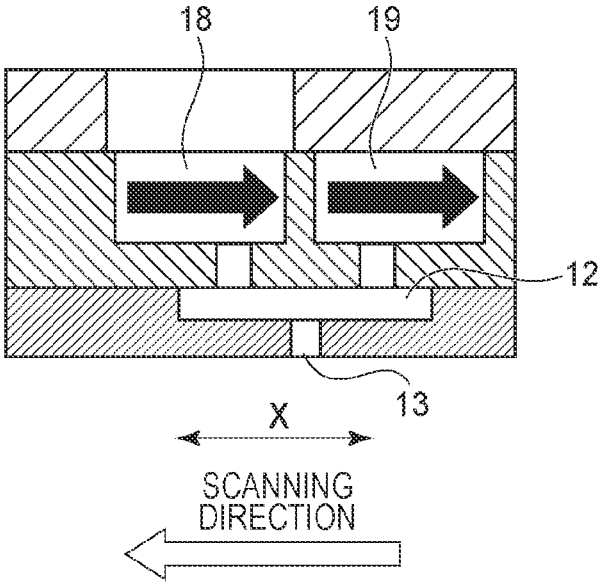
FIGS. 21A and 21B are cross-sectional views of the vicinity of a discharge port of a comparative example.
Figure 21B:
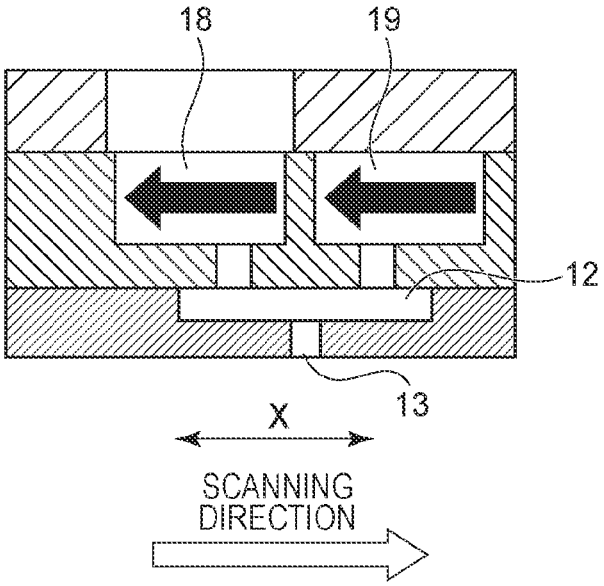

FIGS. 20A and 20B are cross-sectional views of the vicinity of the discharge port 13 of the discharge module 300. FIGS. 21A and 21B are cross-sectional views of a discharge module of a comparative example in which the common supply channel 18 and the common collecting channel 19 are expanded in the X-direction. The thick arrows shown in the common supply channel 18 and the common collecting channel 19 in FIGS. 20A and 20B and FIGS. 21A and 21B indicate the sway of ink in a configuration in which the serial liquid discharge apparatus 50 is used. The ink supplied to the pressure chamber 12 through the common supply channel 18 and the supply connecting channel 323 is discharged from the discharge port 13 by the driving of the discharge element 15. When the discharge element 15 is not driven, the ink is collected from the pressure chamber 12 to the common collecting channel 19 through the collection connecting channel 324 serving as a collecting channel.

Discharge of such circulating ink in the configuration using the serial liquid discharge apparatus 50 is affected not a little by the ink sway in the ink channel due to the scanning of the liquid discharge head 1. Specifically, the effect of the ink sway in the ink channel may cause difference in the ink discharge amount or shift in the discharge direction. In the case where the common supply channel 18 and the common collecting channel 19 have a wide cross-sectional shape in the X-direction, or the scanning direction, as shown in FIGS. 21A and 21B, the ink in the common supply channel 18 and the common collecting channel 19 are susceptible to the effect of an inertial force in the scanning direction to generate great sway in the ink. The ink sway can affect the discharge of ink from the discharge port 13. The expansion of the common supply channel 18 and the common collecting channel 19 in the X-direction may increase the distance between the colors, decreasing the efficiency of printing.

For this reason, the common supply channels 18 and the common collecting channels 19 of this embodiment extend in the Y-direction in the cross-section shown in FIGS. 20A and 20B, and extend also in the Z-direction perpendicular to the X-direction, or the scanning direction. This configuration allows the widths of the common supply channels 18 and the common collecting channels 19 in the scanning direction to be decreased. The decrease in the widths of the common supply channel 18 and the common collecting channel 19 in the scanning direction allows reduction in ink sway due to the inertial force (the thick arrows in the drawings) acting on the ink in the common supply channel 18 and the common collecting channel 19 in the direction opposite to the scanning direction during scanning. This can reduce or eliminate the effect of the ink sway on the discharge of ink. The extension of the common supply channel 18 and the common collecting channel 19 in the Z-direction increases the cross-sectional areas, thereby reducing the channel pressure loss.

Although the ink sway in the common supply channel 18 and the common collecting channel 19 is reduced by decreasing the widths of the common supply channel 18 and the common collecting channel 19 in the scanning direction, not the sway is entirely eliminated. For this reason, to prevent the difference in discharge among the ink kinds, which can be caused even by the reduced sway, this embodiment is configured such that the common supply channels 18 and the common collecting channels 19 are aligned in the Y-direction.

In this embodiment, the supply connecting channel 323 and the collection connecting channel 324 are disposed in correspondence with the discharge port 13, and the supply connecting channel 323 and the collection connecting channel 324 are disposed side by side in the X-direction, with the discharge port 13 therebetween, as described above. For this reason, if the common supply channel 18 and the common collecting channel 19 are not aligned in the X-direction, so that the correspondence relationship between the supply connecting channel 323 and the collection connecting channel 324 in the Y-direction is broken, the flow and discharge of the ink in the pressure chamber 12 in the Y-direction is affected. Additional effect of the ink sway may affect discharge of ink from each discharge port 13.

Accordingly, disposing the common supply channel 18 and the common collecting channel 19 so as to coincide in the Y-direction allows the ink sway in the common supply channel 18 and the common collecting channel 19 during scanning to be substantially equal at any position in the Y-direction in which the discharge ports 13 are arrayed. This prevents significant variations in pressure difference between the common supply channel 18 and the common collecting channel 19 in the pressure chamber 12, allowing stable discharge.

In some liquid discharge heads, channels for supplying ink to the liquid discharge heads and channels for collecting ink are the same channels. In contrast, in this embodiment, the common supply channel 18 and the common collecting channel 19 are different channels. The supply connecting channel 323 and the pressure chamber 12 communicate with each other, the pressure chamber 12 and the collection connecting channel 324 communicate with each other, and ink is discharged from the discharge port 13 of the pressure chamber 12. In other words, the pressure chamber 12 connecting the supply connecting channel 323 and the collection connecting channel 324 includes the discharge port 13. This causes an ink flow from the supply connecting channel 323 to the collection connecting channel 324 to occur in the pressure chamber 12, thereby circulating the ink in the pressure chamber 12 efficiently. The efficient circulation of the ink in the pressure chamber 12 allows the ink in the pressure chamber 12, which is susceptible to the influence of ink evaporated from the discharge port 13, to be kept fresh.

The communication of the two channels, the common supply channel 18 and the common collecting channel 19, with the pressure chamber 12 enables ink supply through both of the channels if high-flow-rate discharge is needed. In other words, the configuration of this embodiment has the advantage of being able to not only perform efficient circulation but also allowing for high discharge flow rate, as compared with a configuration in which ink supply and collection are performed using only one channel.

The common supply channel 18 and the common collecting channel 19 may be disposed close to each other in the X-direction to prevent the effect of ink sway. The interval between the common supply channel 18 and the common collecting channel 19 is preferably from 75 to 100 μm.

Figure 22:
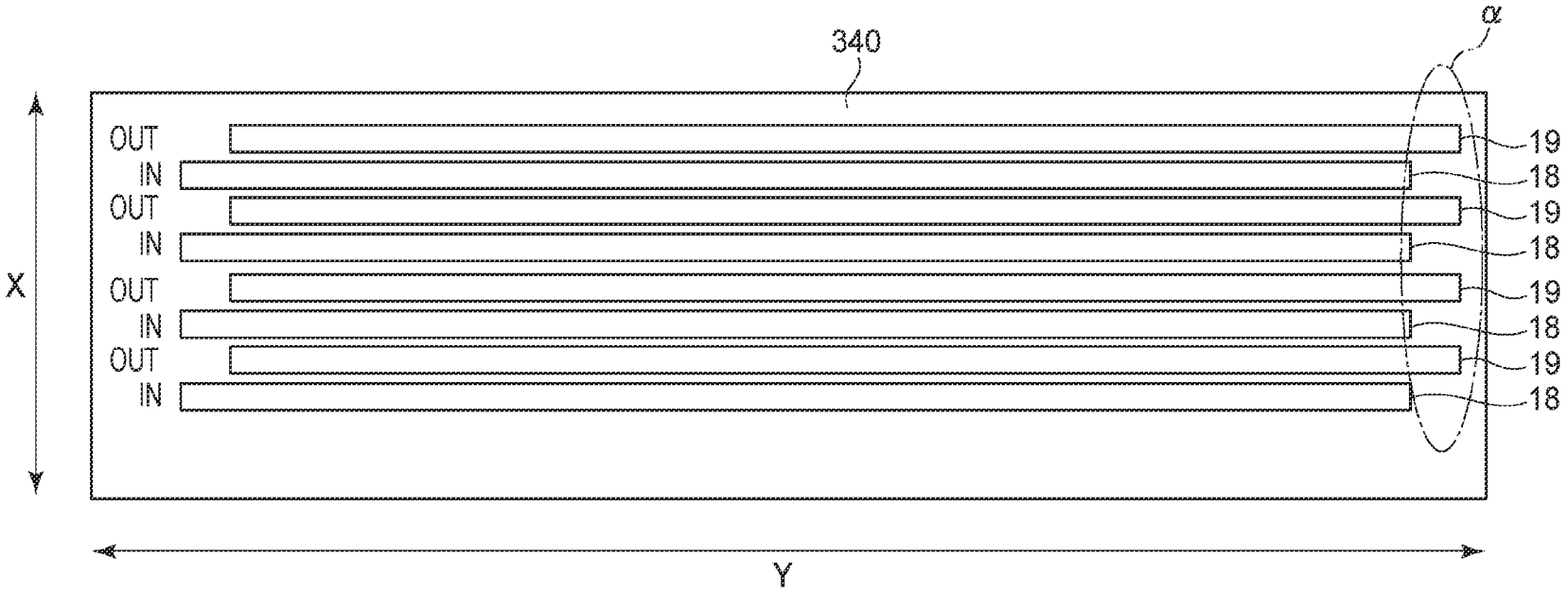
FIG. 22 is a diagram of a discharge element substrate of a comparative example.

FIG. 22 is a diagram of a discharge element substrate 340 of a comparative example. In FIG. 22, the supply connecting channels 323 and the collection connecting channels 324 are omitted. Since the ink flowing into the common collecting channel 19 is subjected to thermal energy by the discharge element 15 in the pressure chamber 12, its temperature is higher than the temperature of the ink in the common supply channel 18. In the comparative example, the discharge element substrate 340 has a portion in the Y-direction, like portion a enclosed by the one-dot chain line in FIG. 22, in which only the common collecting channels 19 are present. In this case, the portion increases locally in temperature, causing temperature variations in the discharge modules 300, which may affect the discharge.

The ink flowing in the common supply channels 18 is lower than the ink in the common collecting channel 19. For this reason, disposing the common supply channel 18 and the common collecting channel 19 next to each other offsets partial temperature with the common supply channel 18 and the common collecting channel 19, thereby preventing an increase in temperature. For this reason, the common supply channels 18 and the common collecting channels 19 may have substantially the same length, may be coincide in the Y-direction and may be next to each other.

FIGS. 23A and 23B are diagrams illustrating the channel configuration of the liquid discharge head 1 for the ink of three colors, cyan (C), magenta (M), and yellow (Y). The liquid discharge head 1 includes circulating channels for the individual kinds of ink, as shown in FIG. 23A. The pressure chambers 12 are disposed in the X-direction, which is the scanning direction of the liquid discharge head 1. As shown in FIG. 23B, the common supply channels 18 and the common collecting channels 19 are disposed along the discharge port arrays in which the discharge ports 13 are arrayed, and the common supply channels 18 and the common collecting channels 19 each extend in the Y-direction, with the discharge port array therebetween.

Having described a liquid discharge apparatus including the liquid discharge head 1 with the diaphragm pump 500, the diaphragm pump 500 may be disposed outside the liquid discharge head 1 and in the casing of a liquid discharge apparatus. In this case, the diaphragm pump 500 circulates the liquid in the liquid discharge head 1 between the liquid discharge head 1 and the diaphragm pump 500. The distance between the diaphragm pump 500 and the discharge ports 13 reduces the effect of the pulsation of the diaphragm pump 500 on the discharge stability.

With the above configuration, providing the diaphragm pump 500 of this embodiment for the liquid discharge head 1 prevents a decrease in the bonding strength of the diaphragm 506 and the supporting member 505, enabling the liquid discharge head 1 to circulate liquid at a stable flow rate for a long period of time. Installing the liquid discharge head 1 including the diaphragm pump 500 in a liquid discharge apparatus enables the liquid discharge apparatus to circulate liquid at a stable flow rate for a long period of time.

Combinations of the configurations of the above embodiments are also applicable.

According to embodiments of the present disclosure, a diaphragm pump in which separation of the adhesive interface of an adhesive that bonds a diaphragm and a supporting member or a metal plate and a diaphragm together can be prevented, and a liquid discharge head and a liquid discharge apparatus including such a diaphragm pump can be provided.

While the present disclosure has been described with reference to exemplary embodiments, it is to be understood that the disclosure is not limited to the disclosed exemplary embodiments. The scope of the following claims is to be accorded the broadest interpretation so as to encompass all such modifications and equivalent structures and functions.

This application claims the benefit of Japanese Patent Application No. 2022-069952 filed Apr. 21, 2022, which is hereby incorporated by reference herein in its entirety.

What is claimed is:

1. A diaphragm pump comprising:

a piezoelectric member configured to deform when a voltage is applied;

a diaphragm having surfaces and configured to deform in response to deformation of the piezoelectric member;

a supporting member configured to support the diaphragm; and an electrode plate positioned between the piezoelectric member and the diaphragm and configured to supply electrical power to the piezoelectric member, wherein a space is formed between the diaphragm and the supporting member, and fluid is made to flow by changing a volume of the space by deforming the diaphragm, wherein the surfaces of the diaphragm include a first surface facing the space and configured to deform in response to deformation of the piezoelectric member and include a second surface that is offset with the first surface, wherein the diaphragm is bonded to the supporting member at the second surface, the electrode plate and the diaphragm are laminated in an axial direction, and, in the axial direction, an outer peripheral edge of the electrode plate is aligned with the second surface, and wherein a part of the diaphragm extends further outward than the second surface in a direction intersecting with the axial direction.

2. The diaphragm pump according to claim 1, wherein the second surface is positioned below the first surface, where, of directions of deformation of the first surface, a direction in which the volume of the space decreases is from above the first surface to below the first surface.

3. The diaphragm pump according to claim 1, wherein a center of the piezoelectric member is out of alignment with a center of the diaphragm as viewed from a direction perpendicular to the first surface.

4. The diaphragm pump according to claim 1, wherein a center of the electrode plate is out of alignment with a center of the diaphragm as viewed from a direction perpendicular to the first surface.

5. The diaphragm pump according to claim 1, further comprising:

an intake hole configured to communicate with the space to suck liquid into the space; and a discharge hole configured to communicate with the space to discharge the liquid in the space, wherein, in an orientation in which the diaphragm is used, the space extends vertically, and the discharge hole is disposed above the intake hole.

* * * * *